US009457219B2

(12) United States Patent
Smith

(10) Patent No.: US 9,457,219 B2
(45) Date of Patent: Oct. 4, 2016

(54) SQUAT EXERCISE APPARATUS

(71) Applicant: ICON Health & Fitness, Inc., Logan, UT (US)

(72) Inventor: Kent M. Smith, Nibley, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 65 days.

(21) Appl. No.: 14/517,910

(22) Filed: Oct. 21, 2014

(65) Prior Publication Data

US 2015/0111708 A1 Apr. 23, 2015

Related U.S. Application Data

(60) Provisional application No. 61/893,020, filed on Oct. 18, 2013.

(51) Int. Cl.

| | |
|---|---|
| ***A63B 21/062*** | (2006.01) |
| ***A63B 23/035*** | (2006.01) |
| ***A63B 23/04*** | (2006.01) |
| *A63B 5/16* | (2006.01) |
| *A63B 71/06* | (2006.01) |

(52) U.S. Cl.

CPC ..... *A63B 21/0628* (2015.10); *A63B 21/4033* (2015.10); *A63B 21/4045* (2015.10); *A63B 23/03525* (2013.01); *A63B 23/0405* (2013.01); *A63B 5/16* (2013.01); *A63B 2023/0411* (2013.01); *A63B 2071/0683* (2013.01); *A63B 2225/50* (2013.01)

(58) Field of Classification Search

CPC ..... A63B 21/0628; A63B 21/062; A63B 21/0624; A63B 21/0626; A63B 21/063; A63B 21/0632; A63B 21/0783; A63B 21/00076; A63B 21/00181

See application file for complete search history.

(56) References Cited

U.S. PATENT DOCUMENTS

| | | | | |
|---|---|---|---|---|
| 5,362,290 | A * | 11/1994 | Huang | A63B 23/0211 482/100 |
| 5,904,638 | A * | 5/1999 | Habing | A63B 22/0605 482/57 |
| 6,251,052 | B1 * | 6/2001 | Simonson | A63B 23/0405 482/100 |
| 7,115,080 | B2 | 10/2006 | Cockrill | |
| 7,255,665 | B2 * | 8/2007 | Ish, III | A63B 21/078 482/100 |
| 7,909,743 | B1 | 3/2011 | Webber | |
| 8,500,608 | B1 | 8/2013 | Bonomi | |
| 8,512,212 | B2 * | 8/2013 | Ish, III | A63B 21/156 482/100 |
| 2012/0277070 | A1 * | 11/2012 | Sienna | A63B 21/06 482/94 |

* cited by examiner

*Primary Examiner* — Oren Ginsberg
*Assistant Examiner* — Megan Anderson
(74) *Attorney, Agent, or Firm* — Holland & Hart LLP

(57) ABSTRACT

A squat exercise apparatus includes a support structure, a plurality of weight members, at least one lift arm, and an actuator. The plurality of weight members is positioned in the support structure. The at least one lift arm has a first end coupled to the support structure and a second end arranged for contact by a user to move the at least one arm vertically during a squat exercise. The actuator assembly is operable by the user to selectively couple the at least one lift arm to at least one of the weight members during the squat exercise. A portion of the actuator assembly is carried by the at least one lift arm.

18 Claims, 23 Drawing Sheets

SQUAT EXERCISE APPARATUS

RELATED APPLICATIONS

This application claims priority to provisional patent application No. 61/893,020 titled "Squat Exercise Apparatus" filed Oct. 18, 2013. This application herein is incorporated by reference for all that it discloses.

BACKGROUND

Various exercises are utilized for toning, strengthening, and rehabilitating muscles of the back and lower body. Among these exercises is the "squat" exercise. The squat exercise involves execution of a variable depth knee bend from a standing position while placing a resistance load upon the body. Traditionally, squat exercise are performed using equal amounts of free weights disposed on each end of a barbell, with the barbell extending across the user's shoulders and resting on his or her upper trapezius muscles. The barbell is held in place by the user gripping the bar with his hands, preferably with a slightly wider than shoulder width grip. More recently, squat exercise machines have been developed in which a variable number of weight members held in a vertical tower of the machine are selectively coupled to lift arms, which the user presses vertically upward to raise the weight members within the tower. The lift arms are coupled to the weight members with a cable and pulley system.

The squat exercise requires caution and ability to perform safely and effectively. A proper squat exercise involves holding a proper stance, adequately supporting the weight against the user's body, maintaining a straight lower back, inclining the trunk through a certain range of inclination, lowering to a position where the thighs are ranged horizontally, and extending the hips and legs from a lowered position to an upright position.

Users may apply various weights for the squat exercise. Regardless of the applied weight, the user may have difficulty moving through a lowering or rising motion during the squat exercise. Providing improved safety and control of when and how the weight is applied to the user during the squat exercise may provide certain advantages.

One type of squat exercise machine is disclosed in U.S. Pat. No. 8,500,608 issued to Roberto Bonomi and assigned to Rhiannon Corp. In this patent, a squat exercise apparatus includes a slidable weight bar assembly along with hand brake assemblies for engaging and disengaging the weight bar assembly with a support frame. Similar squat based exercise machines can also be found in U.S. Pat. Nos. 7,909,743 and 7,115,080. Both of these references are herein incorporated by reference for all that they disclose.

SUMMARY

In one aspect of the invention, an exercise apparatus comprises a plurality of weight members.

In one aspect of the invention, an exercise apparatus may comprise at least one lift arm having a first end coupled the plurality of weight members and a second end arranged for contact by a user to move the at least one lift arm.

In one aspect of the invention, an exercise apparatus may comprise an actuator assembly that selectively couples the at least one lift arm to at least one weight member of the plurality of weight members.

In one aspect of the invention, a portion of the actuator assembly may be carried by the at least one lift arm.

In one aspect of the invention, the actuator assembly may adjust an engagement position of the at least one weight member relative to and during movement of the at least one lift arm.

In one aspect of the invention, at least one hand grip may be coupled to the second end of the at least one lift arm.

In one aspect of the invention, the actuator assembly may comprise a trigger mounted to the at least one hand grip.

In one aspect of the invention, the actuator assembly may comprise a movable release assembly to couple the at least one lift arm to the plurality of weight members or decouple the at least one lift arm from the plurality of weight members.

In one aspect of the invention, the actuator assembly may be biased into a position in which the at least one lift arm is coupled to the plurality of weight members.

In one aspect of the invention, the exercise apparatus may comprise a weight selector operable to select a number of weight members from the plurality of weight members for lifting by the at least one lift arm.

In one aspect of the invention, a carrier rod may extend through the plurality of weight members.

In one aspect of the invention, the weight selector may be selectively connected to the carrier rod to adjust a number of weight members from the plurality of weight members for lifting by the at least one lift arm.

In one aspect of the invention, the actuator assembly may comprise first and second connection members operable between a first position disconnected from the carrier rod to permit movement of the at least one lift arm without lifting the plurality of weight members, and a second position connected to the carrier rod to permit lifting of the plurality of weight members.

In one aspect of the invention, the carrier rod may comprise a plurality of recesses formed therein at spaced apart locations along a length of the carrier rod, wherein the first and second connection members are positioned in one of the plurality of recesses when in the first position.

In one aspect of the invention, the actuator assembly may comprise a biasing member configured to bias the first and second connection members into the first position when at least one weight member of the plurality of weight members is in a lifted position and the actuator assembly is operated to decouple the at least one lift arm from the at least one weight member.

In one aspect of the invention, a counterweight may be coupled to the at least one lift arm, and the first and second connection members may be carried by the counterweight.

In one aspect of the invention, an exercise apparatus may comprise a plurality of weight members.

In one aspect of the invention, the exercise apparatus may comprise at least one lift arm.

In one aspect of the invention, an actuator assembly may comprise a trigger mounted to the at least one lift arm.

In one aspect of the invention, the actuator assembly may comprise a release assembly operating upon actuation of the trigger to selectively couple at least some of the plurality of weight members to the at least one lift arm.

In one aspect of the invention, the at least one lift arm may comprise a hand grip and the trigger may be mounted to the hand grip.

In one aspect of the invention, the exercise apparatus may comprise a counterweight, wherein the release assembly is mounted to the counterweight.

In one aspect of the invention, a carrier rod may be coupled to the plurality of weight members.

In one aspect of the invention, the release assembly may be operable between a first position connected to the carrier rod and a second position disconnected from the carrier rod.

In one aspect of the invention, the actuator assembly may further comprise a cable extending from the trigger to the release assembly.

In one aspect of the invention, the cable may extend through a portion of the at least one lift arm.

In one aspect of the invention, a method of exercising may comprise providing a plurality of weight members, at least one lift arm, and an actuator assembly.

In one aspect of the invention, a method of exercising may comprise supporting the at least one lift arm on a user's shoulders.

In one aspect of the invention, a method of exercising may comprise actuating the actuator assembly at a location remote from the plurality of weight members to selectively couple at least some of the plurality of weight members to the at least one lift arm.

In one aspect of the invention, a method of exercising may comprise moving the at least one lift arm to lift the plurality of weight members.

In one aspect of the invention, the at least one lift arm may comprise a hand grip.

In one aspect of the invention, the actuator assembly may comprise a trigger mounted to the hand grip and actuating the actuator assembly may comprise operating the trigger.

In one aspect of the invention, the actuator assembly may comprise a release assembly coupled to the trigger and operating the trigger may disconnect the release assembly from the plurality of weight members.

Any of the aspects of the invention detailed above may be combined with any other aspect of the invention detailed herein.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1A:
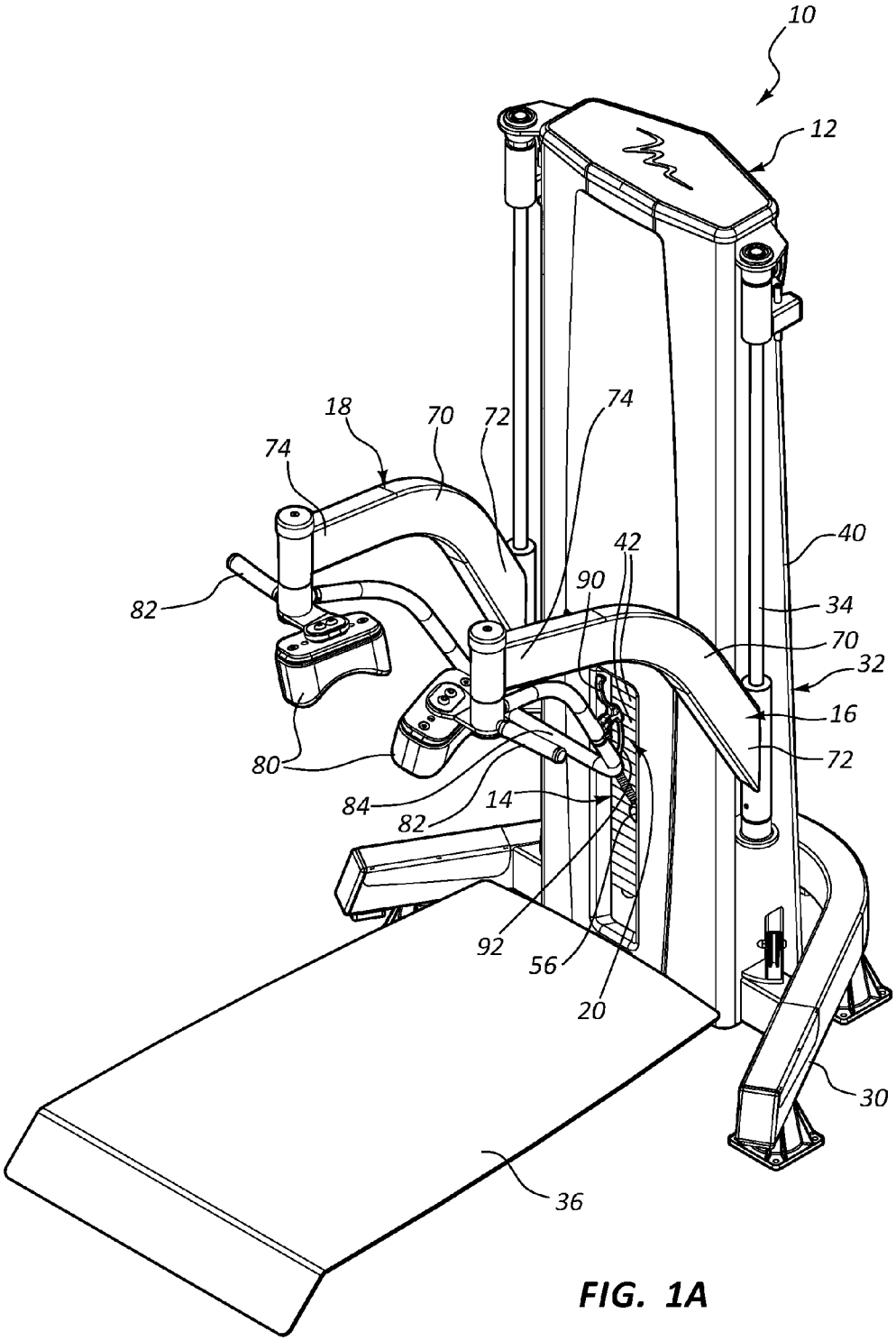
FIG. 1A illustrates a front perspective view of an example exercise apparatus in accordance with the present disclosure.
Figure 1B:
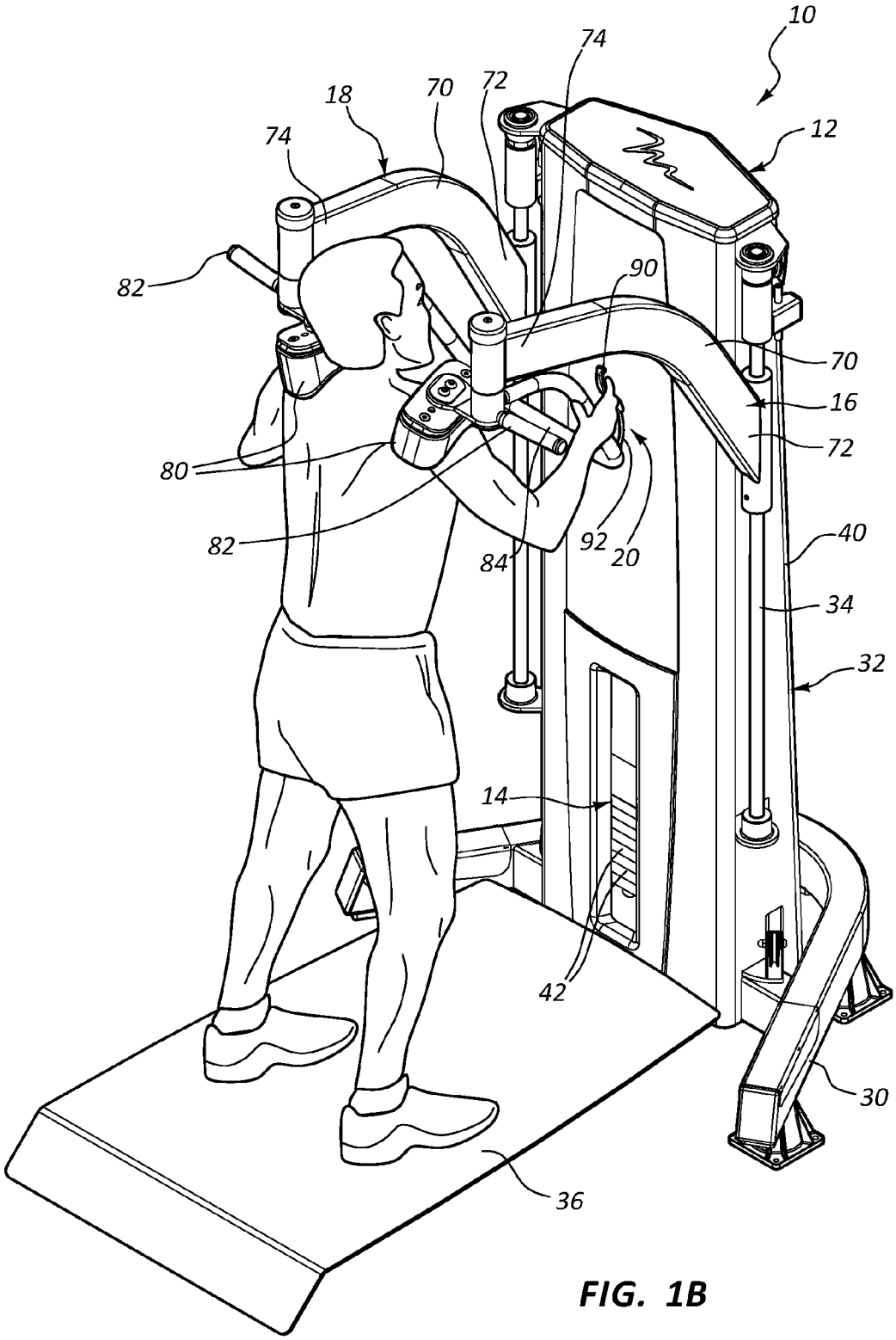
FIG. 1B illustrates a front perspective view of an example exercise apparatus in accordance with the present disclosure.
Figure 2:
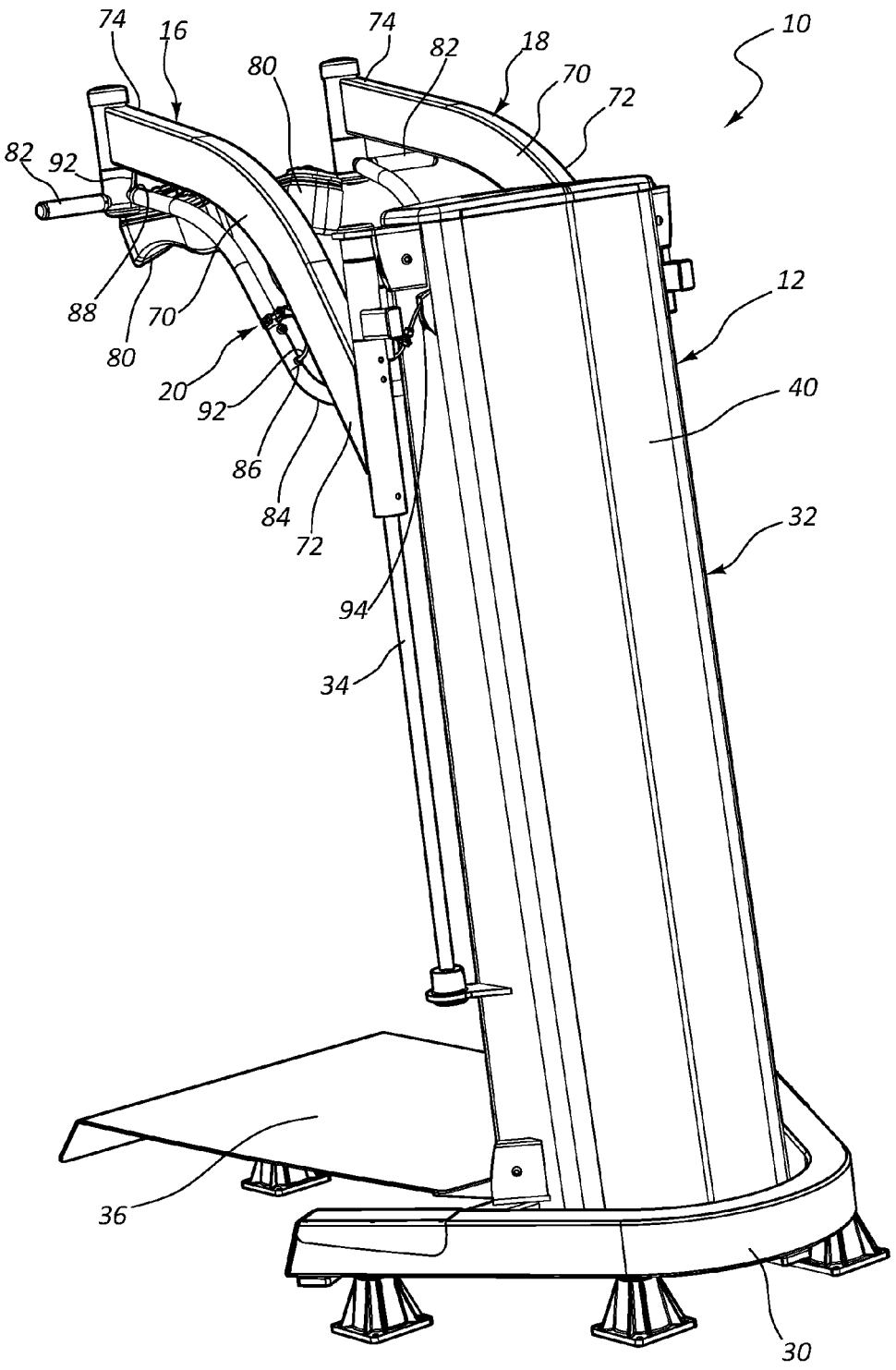
FIG. 2 illustrates a rear perspective view of the exercise apparatus of FIG. 1A.
Figure 3:
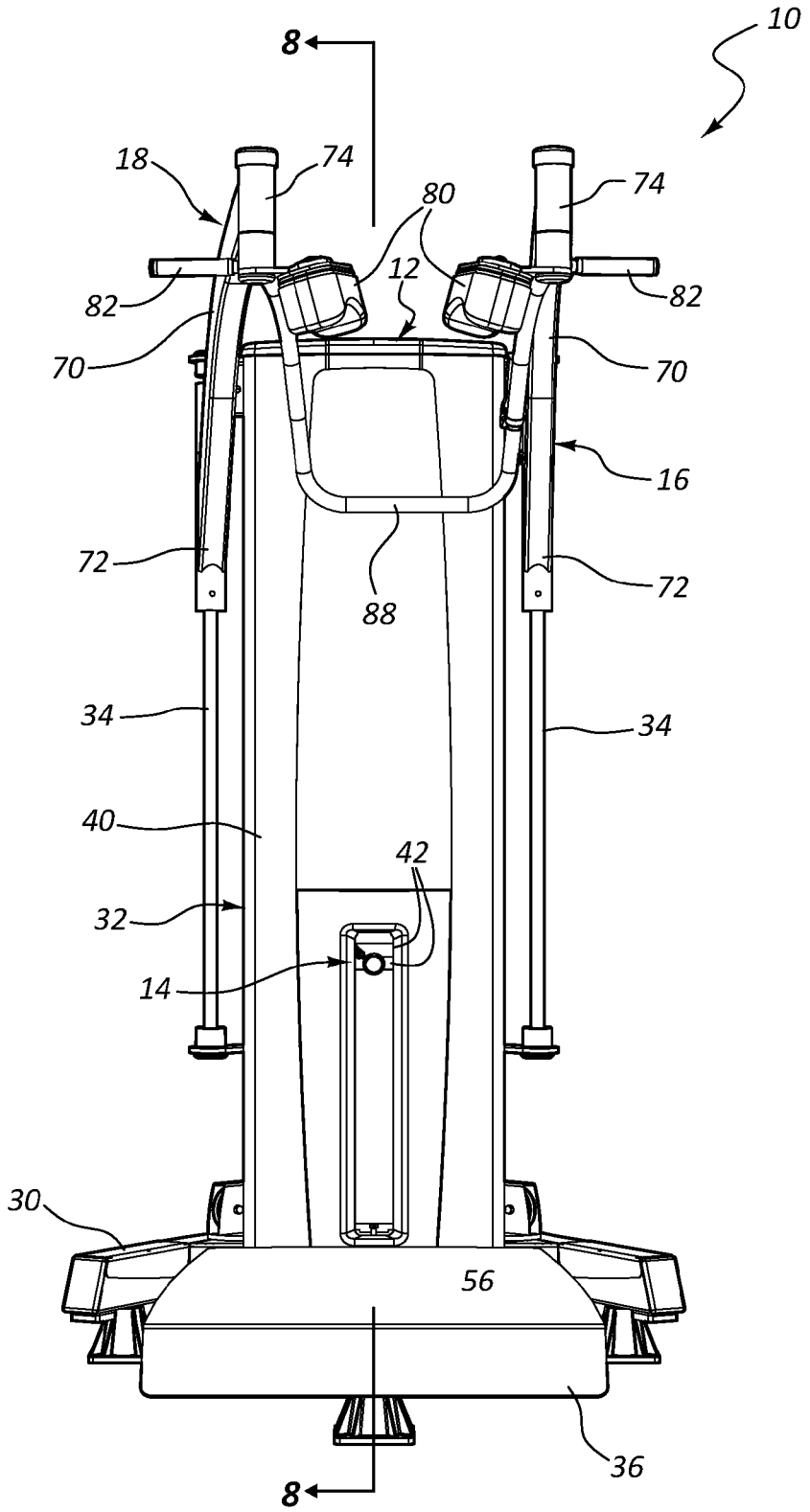
FIG. 3 illustrates a front view of the exercise apparatus of FIG. 1A.
Figure 4:
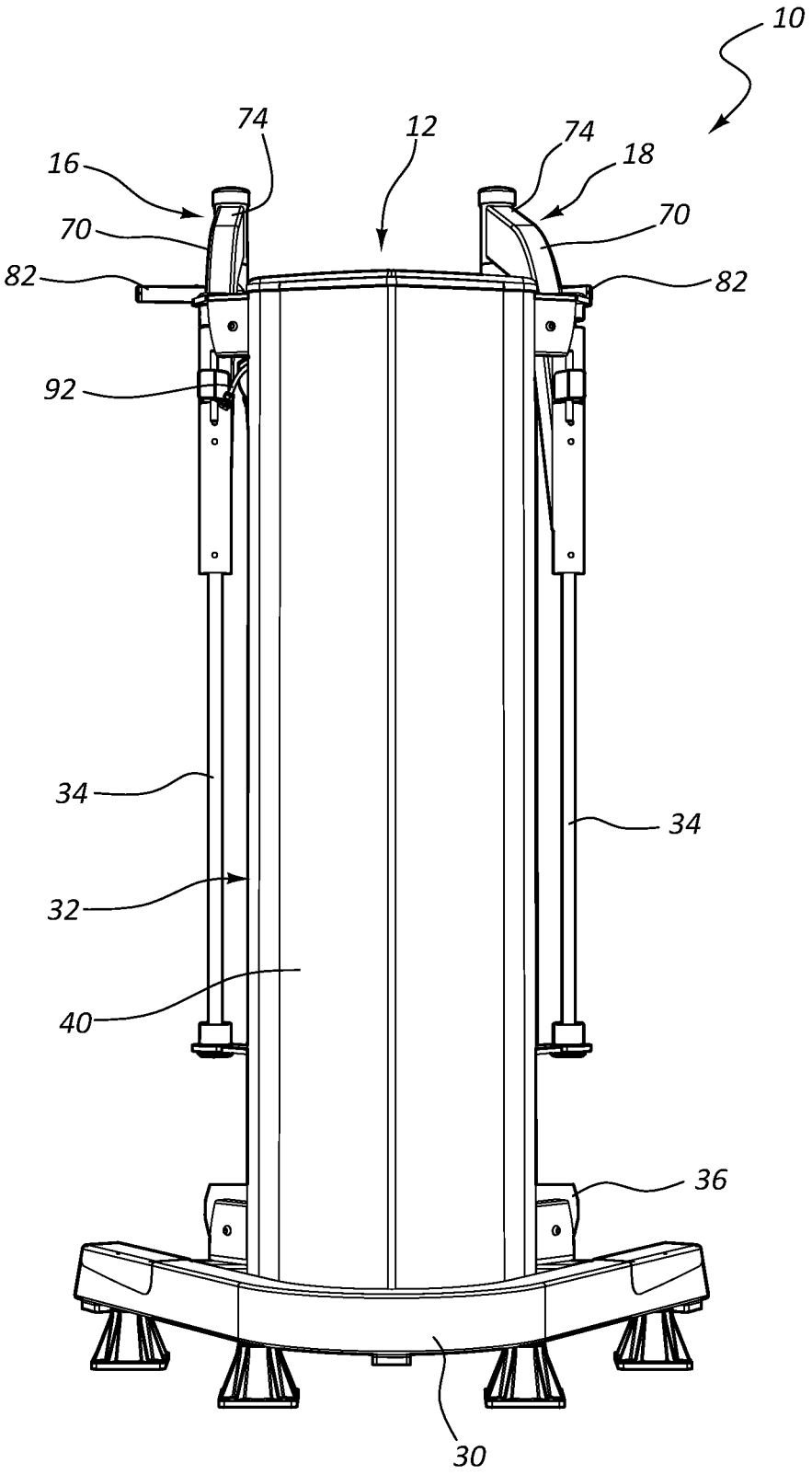
FIG. 4 illustrates a rear view of the exercise apparatus of FIG. 1A.
Figure 5:
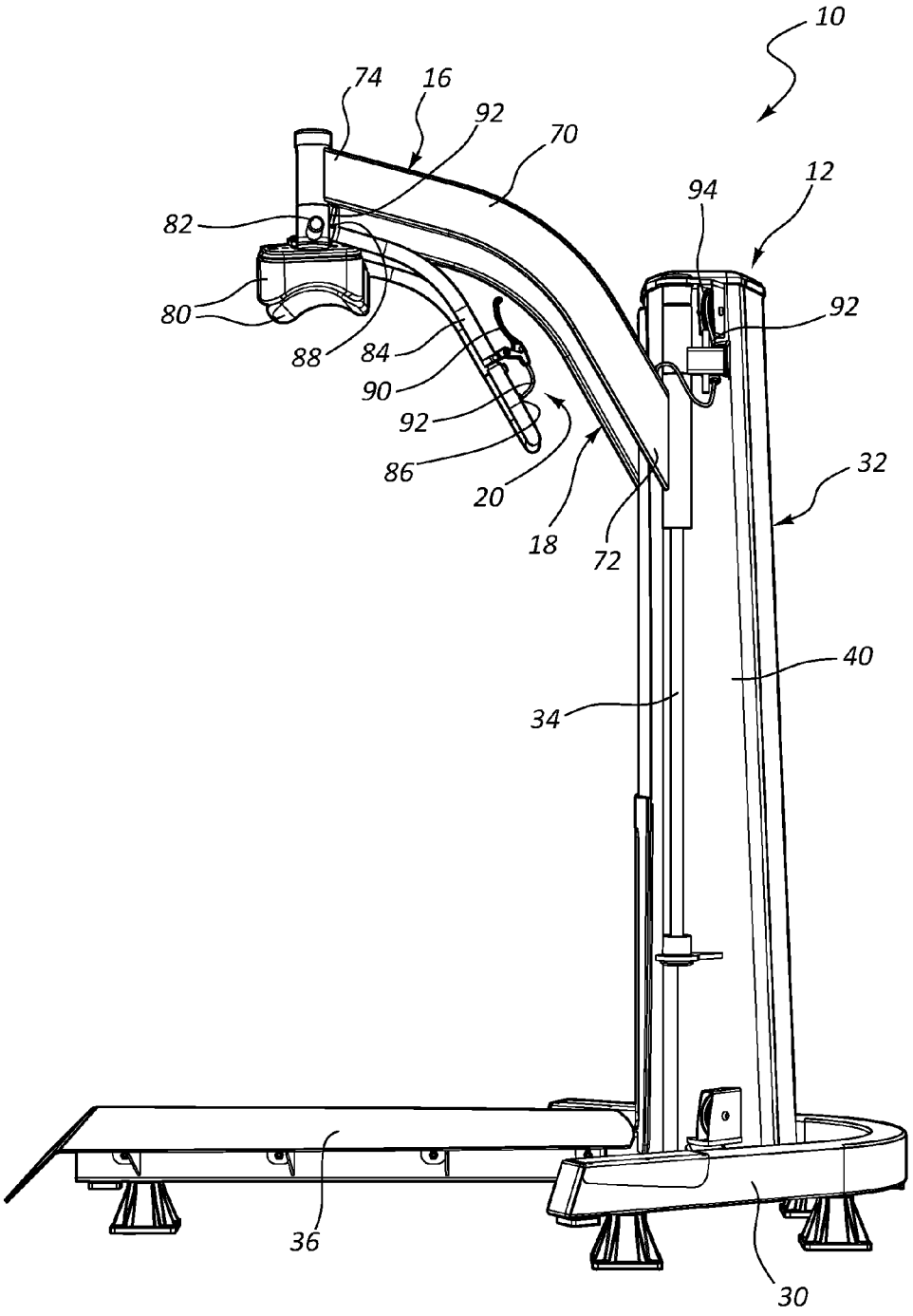
FIG. 5 illustrates a left side view of the exercise apparatus of FIG. 1A.
Figure 6:
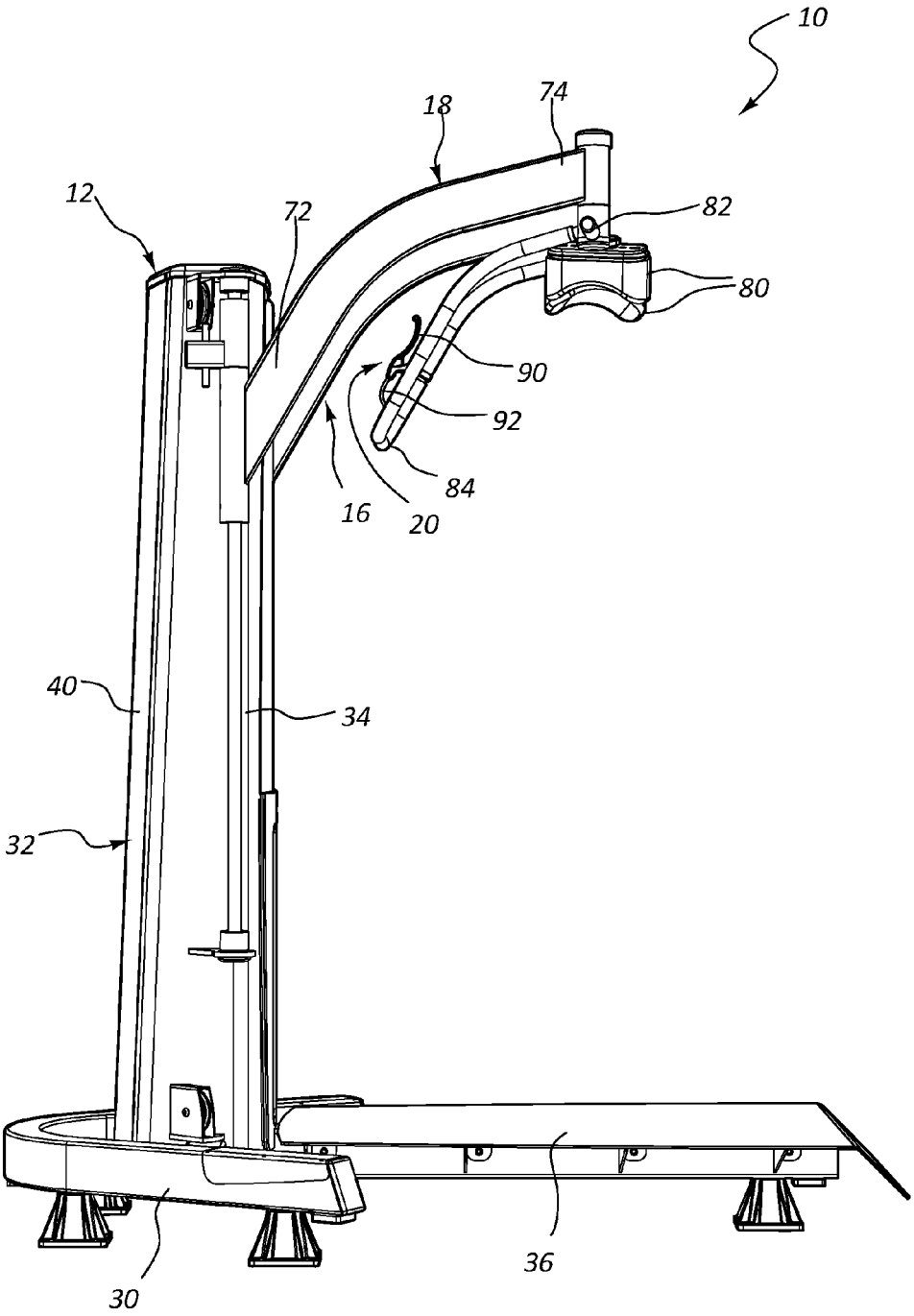
FIG. 6 illustrates a right side view of the exercise apparatus of FIG. 1A.
Figure 7:
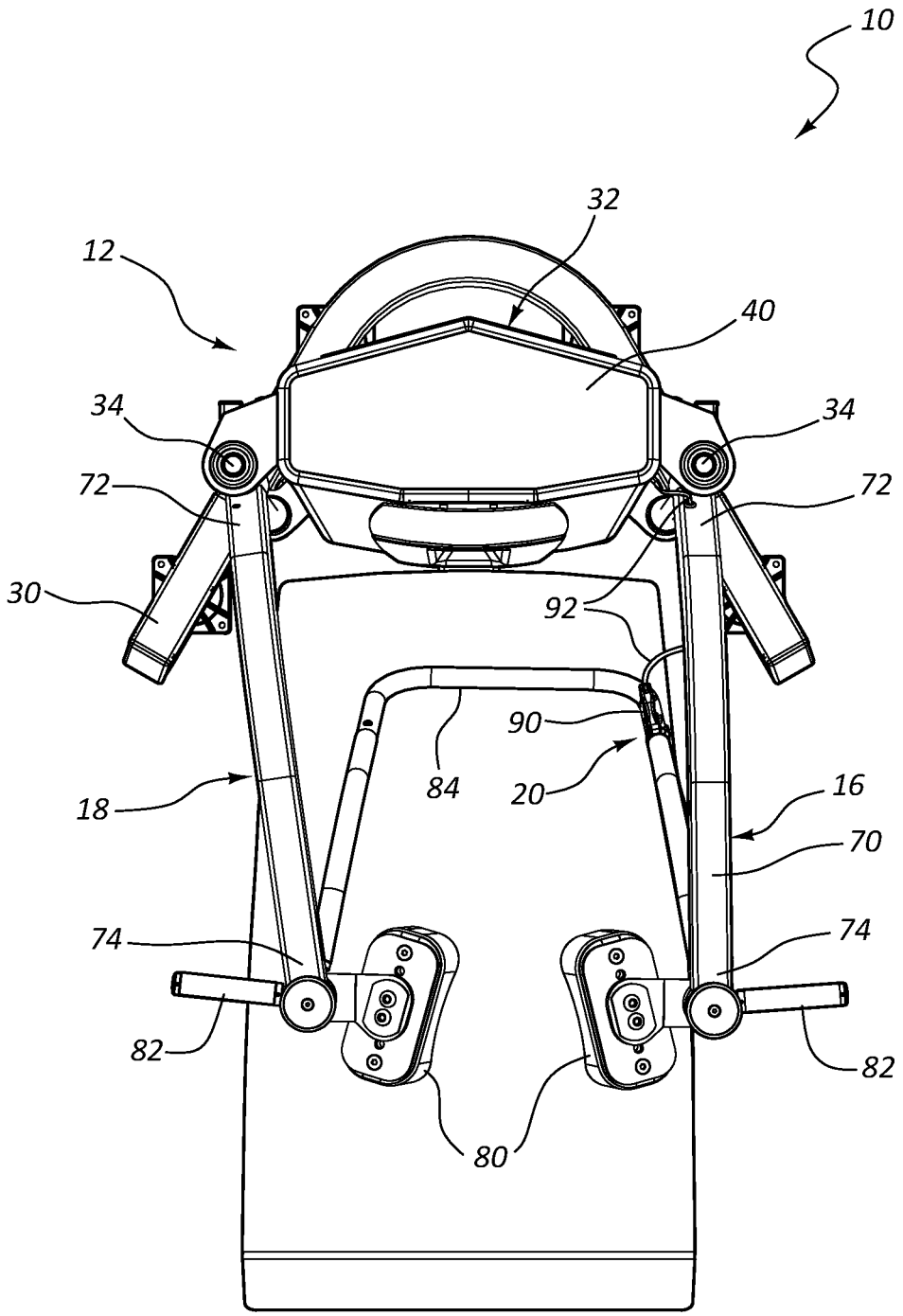
FIG. 7 illustrates a top view of the exercise apparatus of FIG. 1A.

The squat exercise apparatus of the present disclosure may provide additional user control over when the selected weight is applied for lifting by the user. For example, the squat exercise apparatus may include an actuator assembly, which is operable while the user is moving through a squat motion. The actuator assembly may include a trigger or other actuator member that is carried by the lift arms of the squat exercise apparatus. The lift arms may include at least one hand grip or handle portion that is accessible by the user while the shoulder pads, which are also carried by the lift arms, are resting against the user's shoulders. The trigger may be operable while the user is moving through lowering or raising motions of a squat exercise. The trigger may be coupled to at least one connector positioned inside the tower of the squat exercise apparatus. The connector may couple or decouple the selected weight members of a plurality of weight members relative to the lift arms. The actuator assembly may further include features that limit inadvertent actuation of the connector to release the weight members once the user begins lifting the selected weight members of the plurality of weight members.

The actuator assembly may also be operable to define a bottom most position for the squat motion, which may be referred to as a bottom out or lower most position for the squat exercise. Providing the user with the ability to define this lower most position may help limit the user's knee bend depth, and may provide customize squat exercises for the user. While the present description details the actuator assembly incorporated into a squat exercise machine, the present actuator assembly may be used to selectively control the engagement of weight members in any number of exercise machines.

Particularly, with reference to the figures, FIGS. 1A-19 illustrate a squat exercise apparatus 10 or portions thereof. FIGS. 1A-8 show the squat exercise apparatus 10 including a support structure 12, a plurality of weight members 14, first and second lift arm assemblies 16, 18, an actuator assembly 20, and a counterweight assembly 22. The plurality of weight members 14 are housed within the support structure 12. The first and second lift arm assemblies 16, 18 are mounted to the support structure 12. The actuator assembly 20 includes a portion thereof mounted to one of the first and second lift arm assemblies 16, 18, and other portions thereof positioned within the support structure 12. The counterweight assembly 22 is also positioned within the support structure 12 (see FIGS. 8-9).

The support structure 12 includes a base 30, a tower 32, arm supports 34, and a platform 36. The base 30 holds the tower 32 in a vertical or upright orientation. The arm supports 34 extend along at least a portion of a length of the tower 32. The first and second lift arm assemblies 16, 18 slide along the arm supports 34 between raised and lowered positions. A platform 36 extends from a front side of the support structure 12 and provides a surface or platform upon which the user stands during operation of the squat exercise apparatus 10. The tower 32 may include frame members 38 (see FIGS. 8, 9 and 19) and a cover 40. The cover 40 may enclose the frame members 38 another feature to the squat exercise apparatus such as, for example, the plurality of weight members 14 and counterweight assembly 22.

Figure 8:
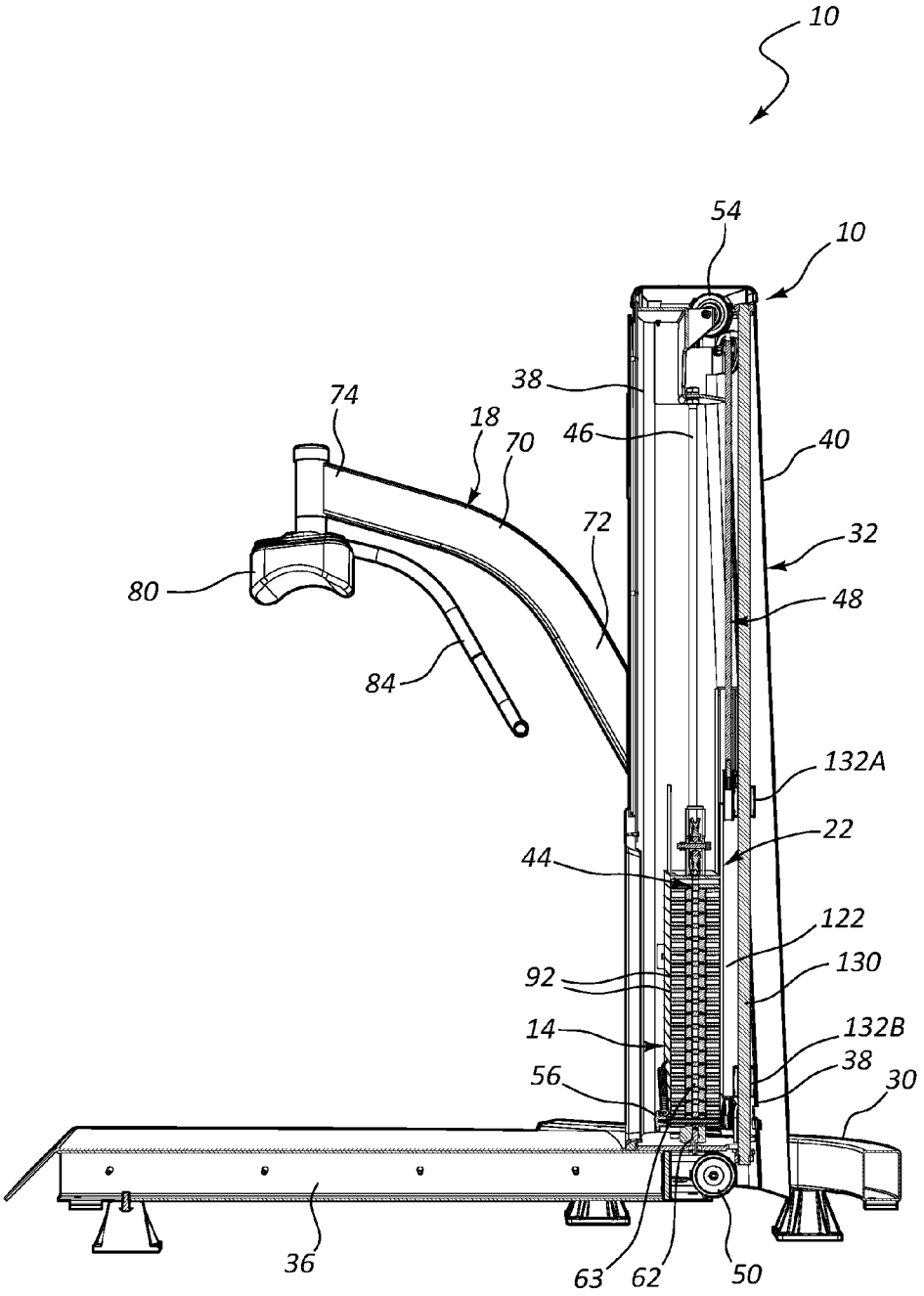
FIG. 8 illustrates a cross-sectional view of the exercise apparatus of FIG. 3 taken along cross-section indicators 8-8.
Figure 18A:
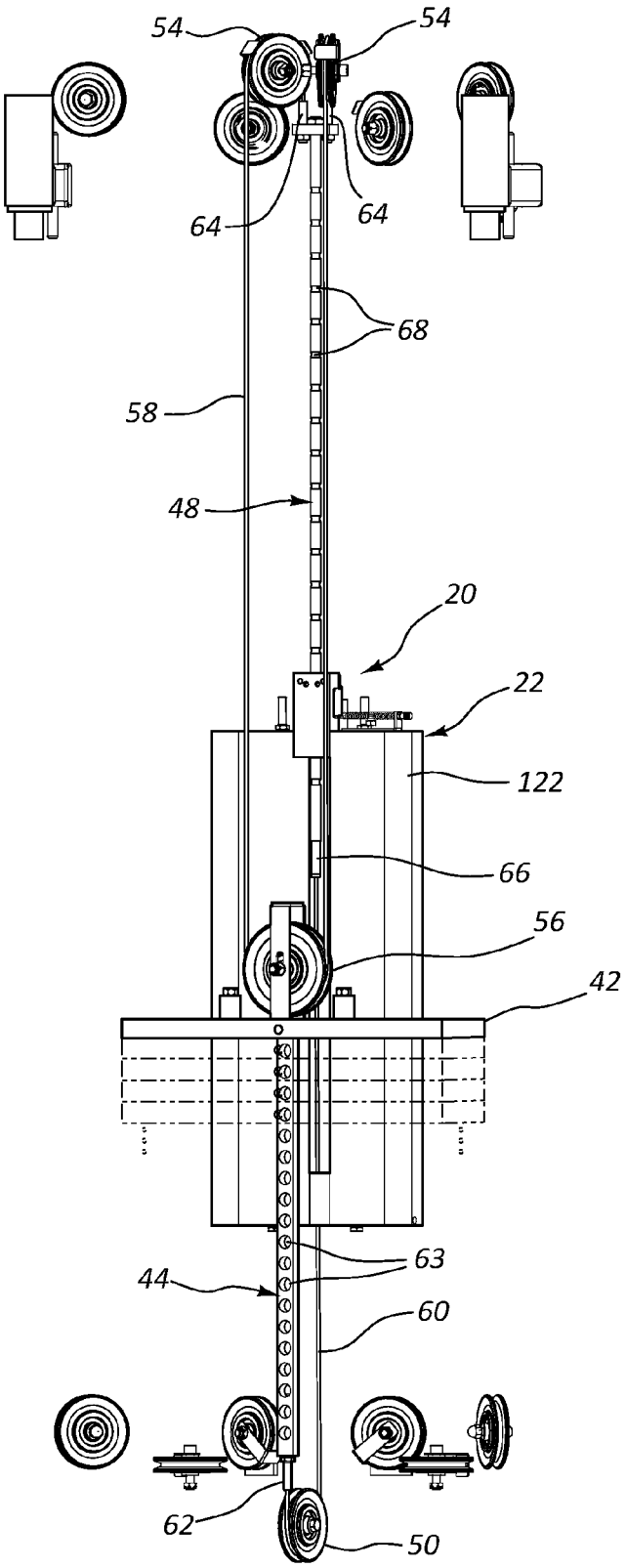
FIG. 18A illustrates a rear view of a portion of a plurality of weight members assembly of the squat exercise apparatus in a lowered position.
Figure 18B:
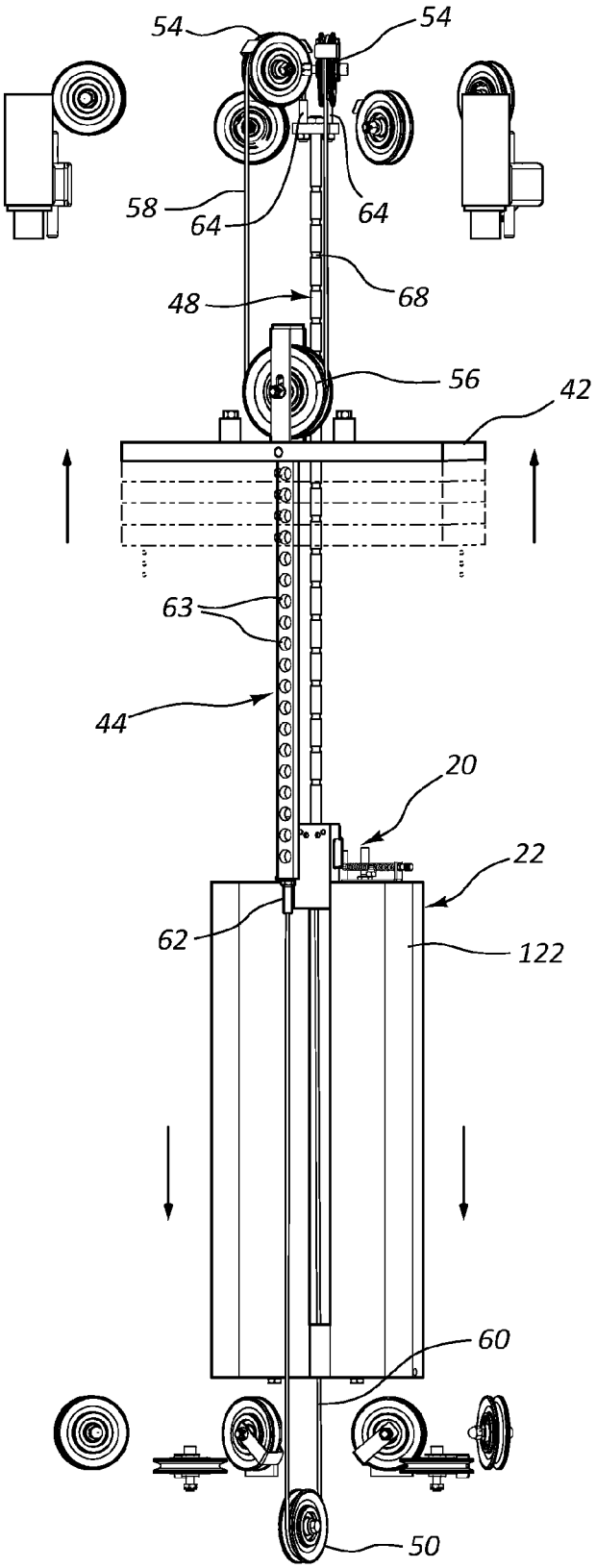
FIG. 18B illustrates a rear view of the plurality of weight members assembly of FIG. 18A in a raised position.

The plurality of weight members 14 are shown in at least FIG. 8 including a plurality of weight members 42, a selector rod 44, guide rods 46, and a carrier rod 48. Referring to FIGS. 18A and 18B, the plurality of weight members 14 may further include a plurality of bottom weight pulleys 50, a middle weight pulley 52, a plurality of top weight pulleys 54, and first and second weight cables 58, 60. A selector 56 (see FIGS. 1A and 8) may be removably inserted into the weight members 42 and into contact with the selector rod 44 to adjust the number of weight members 42 lifted by the user.

Referring to FIGS. 8 and 18A-B, the selector rod 44 includes a cable connector 62 at a bottom end thereof, and a plurality of apertures 63 receptive of the selector 56. A separate aperture 63 may be associated with each of the weight members 42. The carrier rod 48 may be releasably connected to the weight members 42 by operation of the actuator assembly 20. FIGS. 18A-B show the carrier rod 48 having top and bottom cable connectors 64, 66, and a plurality of recesses 68 spaced along a length of the carrier rod 48. The top cable connector 64 provides a connection to opposing free ends of the first weight cable 58. The first weight cable 58 wraps around the middle weight pulley 52 and over the top weight pulleys 54. The second weight cable 60 has a first end connected to the bottom cable connector 66 of the carrier rods 48, and an opposite end connected to the cable connector 62 of the selector rod 44. The second weight cable 60 wraps around the bottom weight pulley 50. The weight members 42 are moved up and down by the user typically only when the carrier rod 48 is connected to the counterweight assembly 22 via the actuator assembly 20. The actuator assembly 20 is connected to the carrier rod 48 at one of the recesses 68.

Referring again to FIG. 1A, the first and second lift arm assemblies 16, 18 each include a lift arm 70 having first and second ends 72, 74. The first end 72 of the lift arm 70 may be coupled to the plurality of weight members 14. The second end 74 of the lift arm 70 may be arranged for contact by a user to move the lift arm 70. The first lift arm assembly 16 includes first and second cable openings 76, 78 formed in the lift arm 70 (see FIG. 19). The first and second lift arm assemblies 16, 18 each also carry a shoulder pad 80 and a first grip 82. A second hand grip 84 extends between the second ends 74 of the lift arm 70. The second hand grip 84 includes first and second cable openings 86, 88 (see FIG. 19). The first and second cable openings 76, 78 and first and second cable openings 86, 88 provide a pathway for a cable of the actuator assembly 20 to travel from the second hand grip 84 and into the tower 32 of the support structure 12, as shown in FIG. 19.

The first and second lift arm assemblies 16, 18 are supported by the support structure 12 on the arm supports 34. The first and second lift arm assemblies 16, 18 move vertically up and down while a user performs a squat exercise.

The first and second lift arm assemblies 16, 18 are coupled to the counterweight assembly 22 at all times. The first and second lift arm assemblies 16, 18 may additionally be coupled to the plurality of weight members 14 at a first end in response to operation of the actuator assembly 20. During typical use, a user stands on the platform 36 facing the tower 32 with the shoulder pads 80 positioned on the user's shoulders. The user grasps either the first or second grips 82, 84 with his hands. A distance that the first and second arm assemblies 16, 18 move in a vertically downward direction is controlled at least in part by where the actuator assembly 20 engages the carrier rod 48 along the length of the carrier rod 48 (e.g., at one of the axially spaced apart recesses 68).

Figure 19:
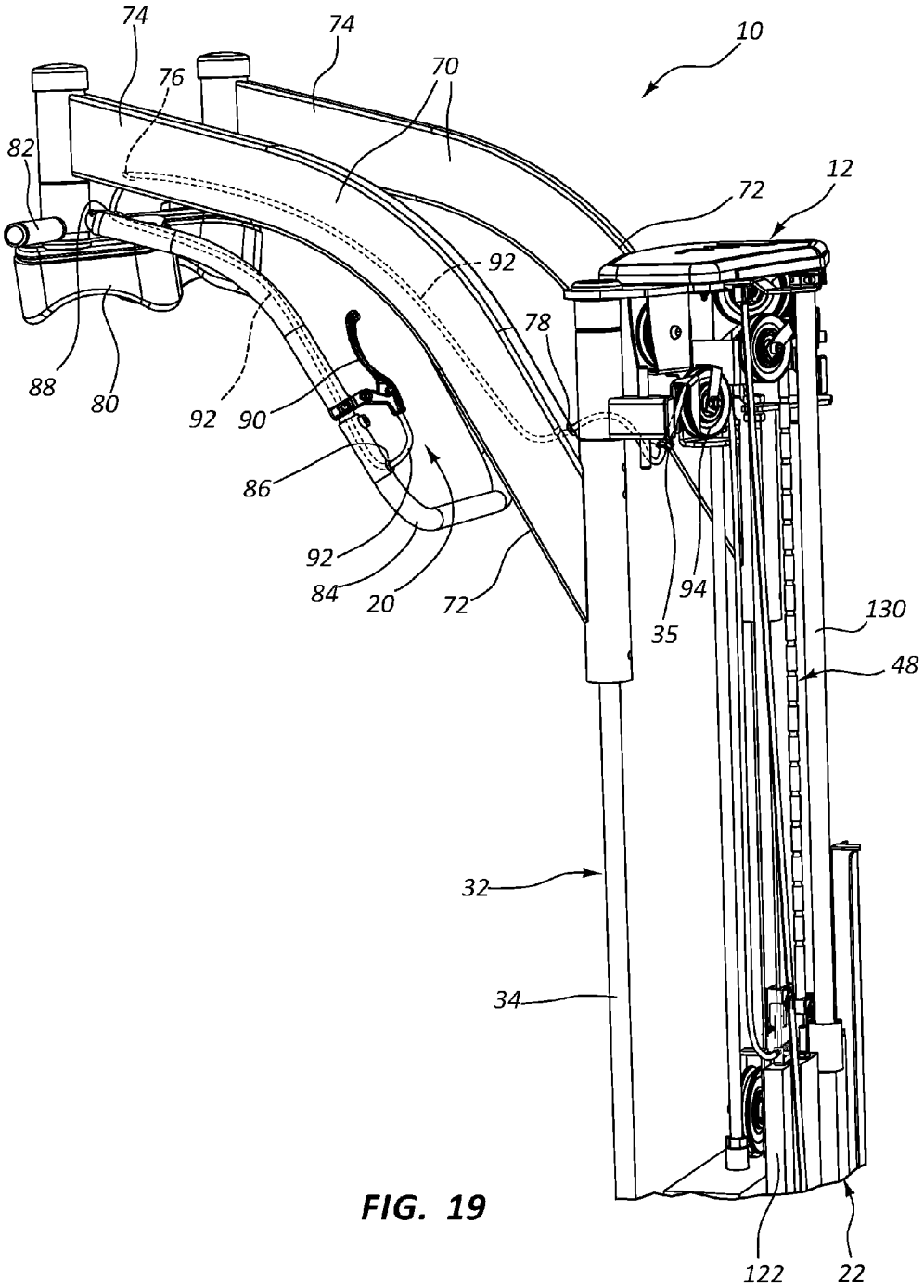
FIG. 19 illustrates a rear perspective view of a portion of the exercise apparatus of FIG. 1A showing a cable path of the actuator assembly.

The actuator assembly 20 is shown in part in FIGS. 9-16 and 19. FIG. 19 shows the actuator assembly 20 having a trigger 90, a cable 92, and a cable pulley 94. The trigger 90 is mounted to the second hand grip 84. Alternatively, the trigger 90 may be positioned on the first grip 82 or at any location on one or both of the first and second lift arm assemblies 16, 18. The cable 92 extends from the trigger 90, through the first cable opening 86, through an interior of the second hand grip 84, out through the second cable opening 88 and into the first cable opening 76 of the lift arm 70. The cable 92 may further extend through an interior of the lift arm 70, out through the second cable opening 78, between the tower 32 and the arm support 34, through a guide 35, over the cable pulley 94, along a length of a portion of the tower 32, and to the counterweight assembly 22. Operating the trigger 90 applies tension in the cable 92 and may move a portion of the cable axially along its length.

The actuator assembly 20 further includes a cable connector 96, a first and second cable springs 98A, B, a lever 100, a lever pivot member 102, linkage 104, first and second connectors 106, 108, connector axles 110, connector springs 112, a housing 114, and a mounting bracket 116, as shown in FIGS. 9-16. The first and second cable springs 98A, B are connected to the cable connector 96. The cable connector 96 may be interposed between the first and second cable springs 98A, B. The first and second cable springs 98A, B may be interposed between a portion of the mounting bracket 116 and the lever 100, with the first cable spring 98A connected to the lever 100. The lever 100 is pivotally connected to the housing 114 with the lever pivot member 102. The lever 100 is pivotally coupled to the linkage 104, which is coupled to the first and second connectors 106, 108 via the connector axles 110.

Figure 10:
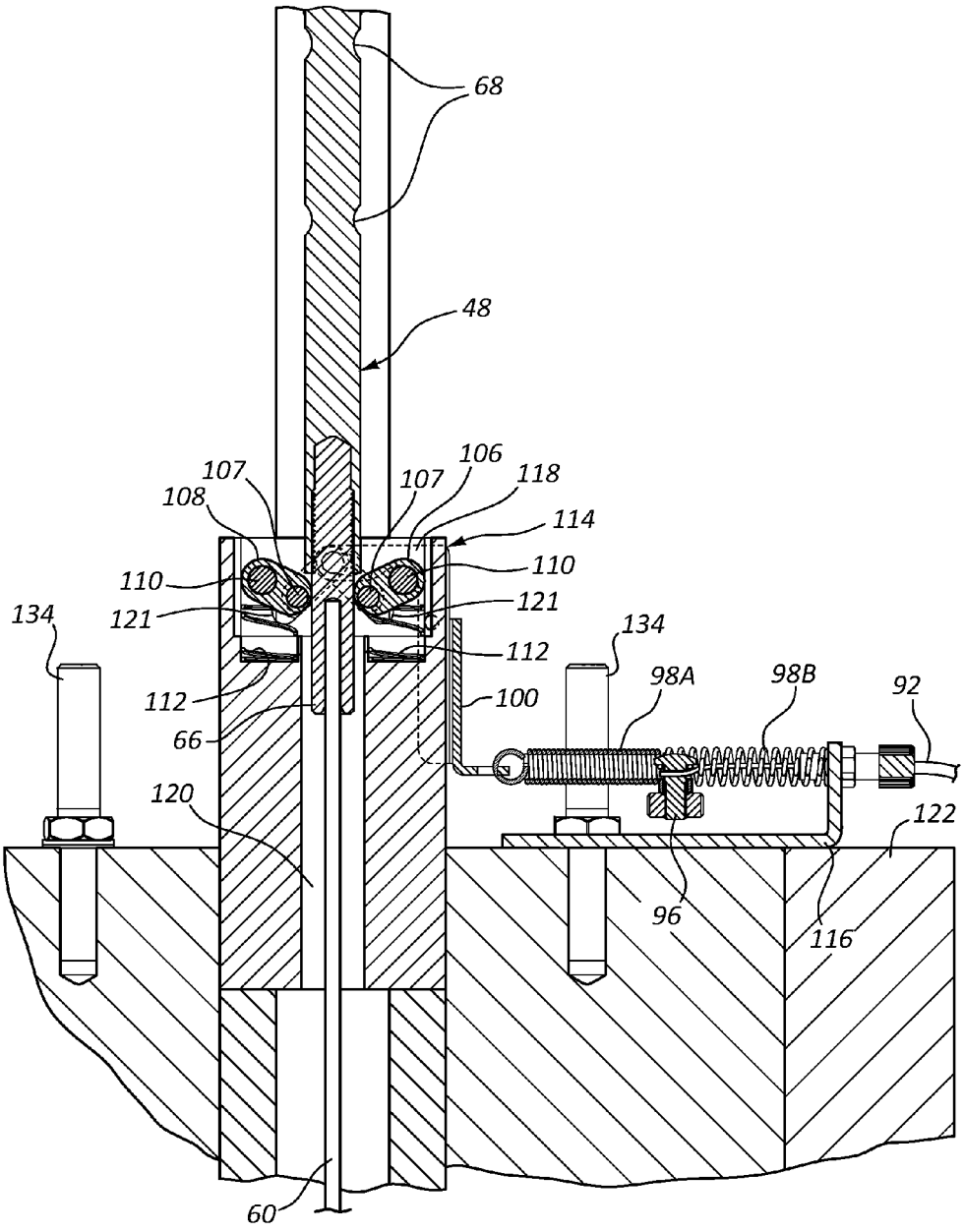
FIG. 10 illustrates a front view of the portion of the actuator assembly of FIG. 9.
Figure 12:
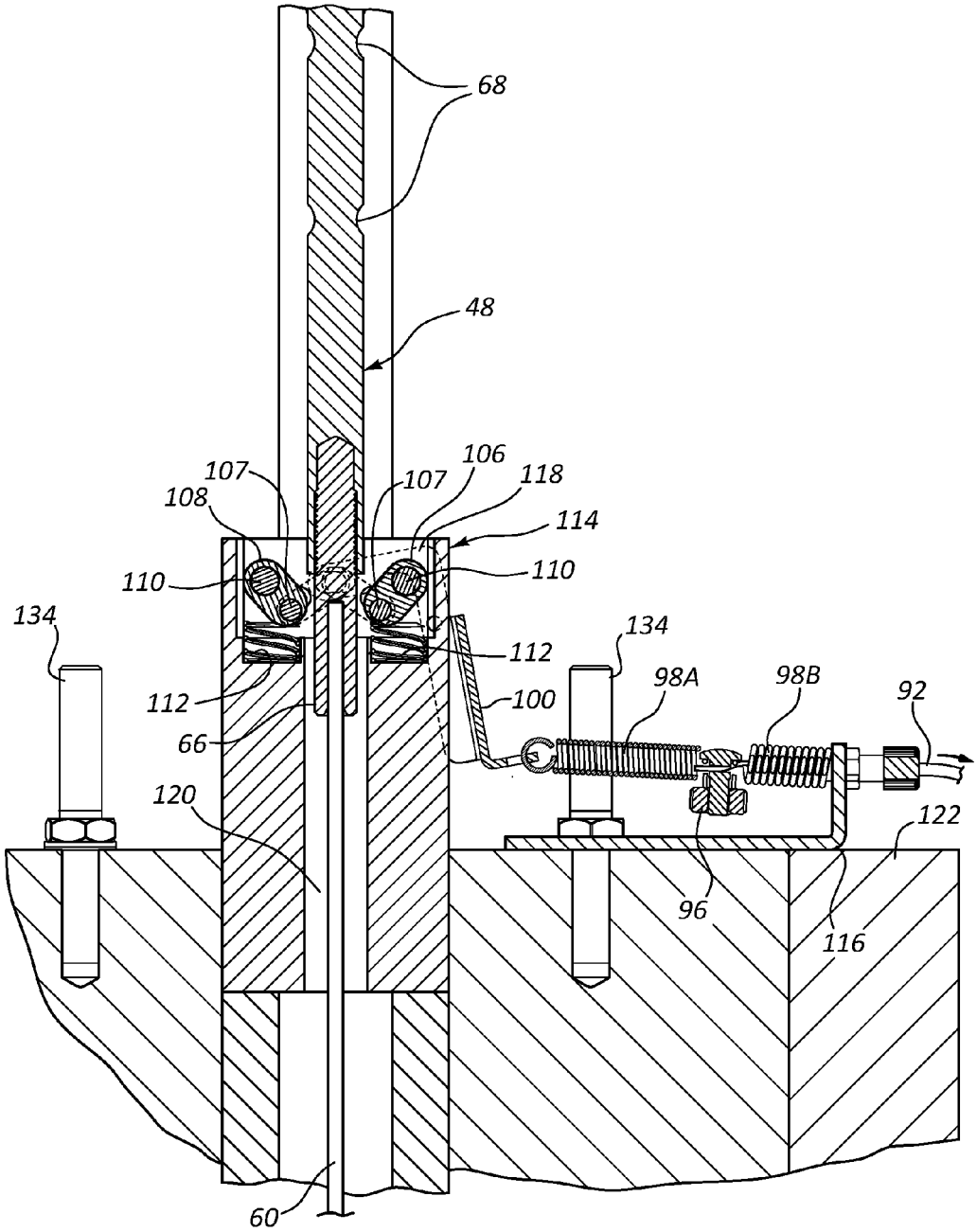
FIG. 12 illustrates a front view of the portion of the actuator assembly of FIG. 11.
Figure 14:
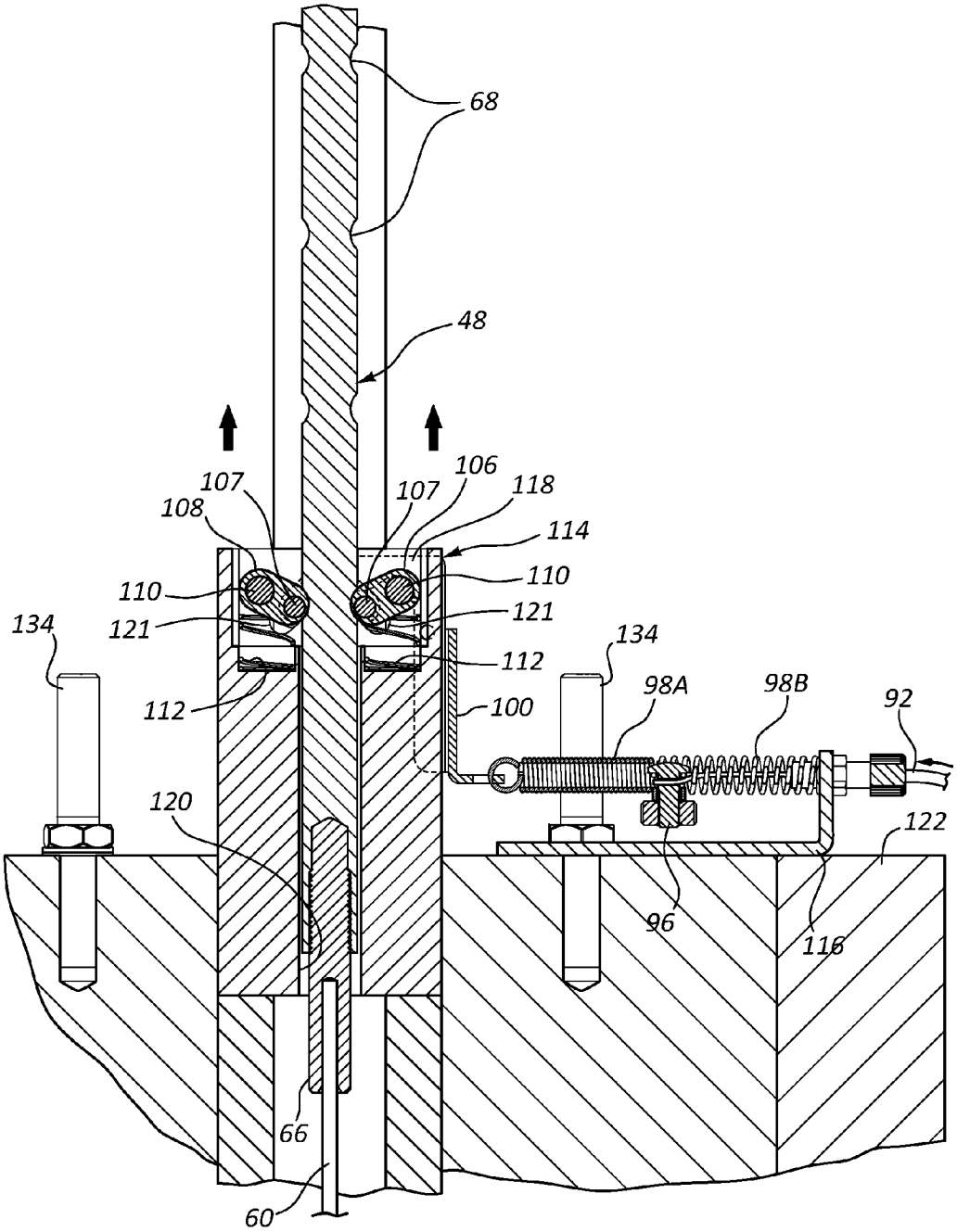
FIG. 14 illustrates a front view of the portion of the actuator assembly of FIG. 13.

Referring to FIG. 10, the housing 114 includes a connector cavity 118 and a pass through bore 120. The first and second connectors 106, 108 are positioned within the connector cavity 118. The pass through bore 120 is sized for passage of the carrier rod 48 through the housing 114. The actuator assembly 20 is operable to move the first and second connectors 106, 108 into and out of contact with the carrier rod 48. Typically, the first and second connectors 106, 108 provide a releasable, positive connection to the carrier rod 48 within the recesses 68. The first and second connectors 106, 108 include followers 107 that move within tracks 121 formed in the housing 114. FIG. 10 shows the first and second connectors 106, 108 rotated into a locked position. FIG. 12 shows the first and second connectors 106, 108 rotated out of contact with the carrier rod 48 into an unlocked position with the followers 107 rotating along the track 121. FIG. 14 shows the first and second connectors 106, 108 rotated back into the locked position in contact with the carrier rod 48.

Figure 17A:
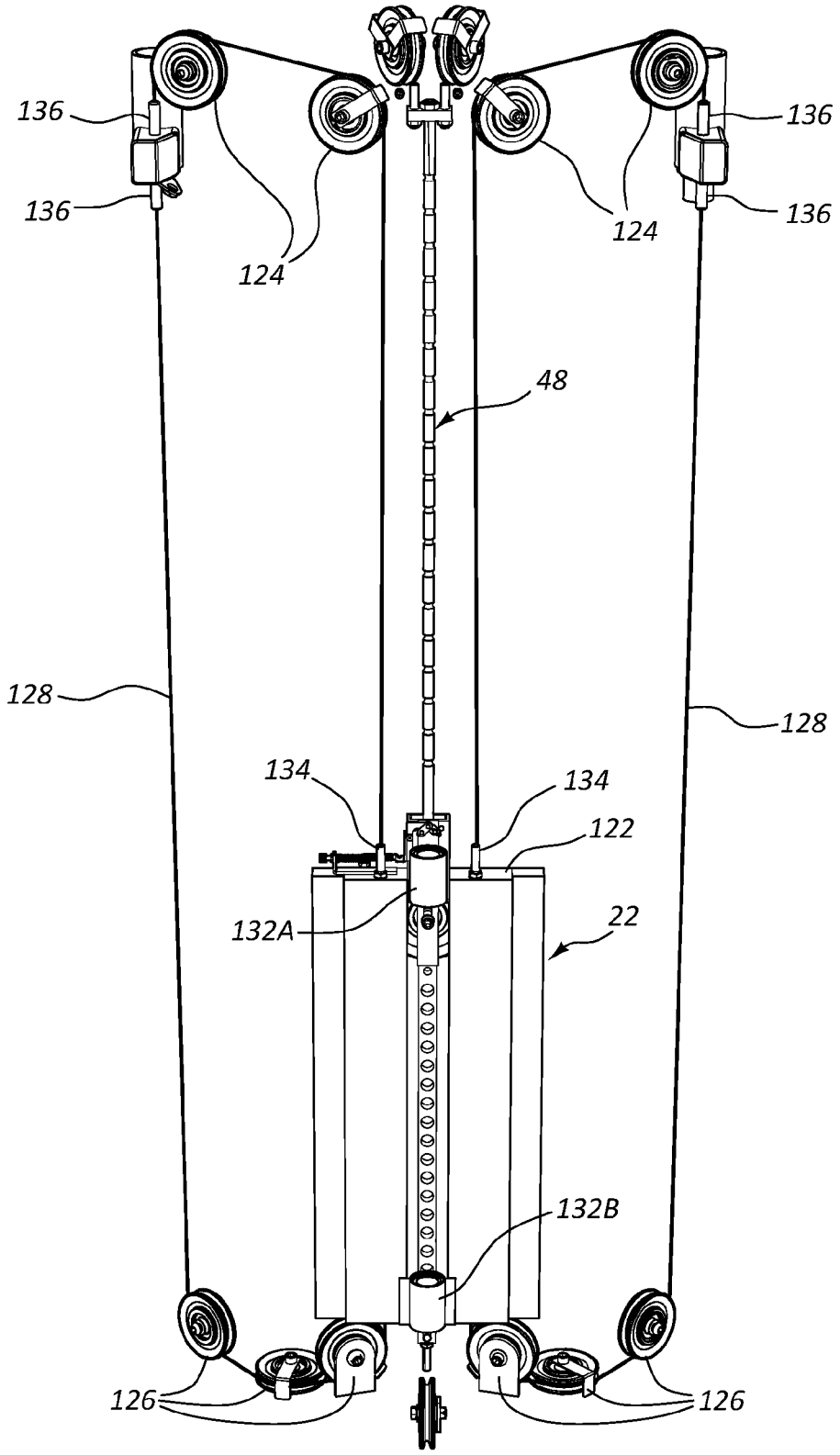
FIG. 17A illustrates a rear view of a counterweight assembly of the squat exercise apparatus in a lowered position.
Figure 17B:
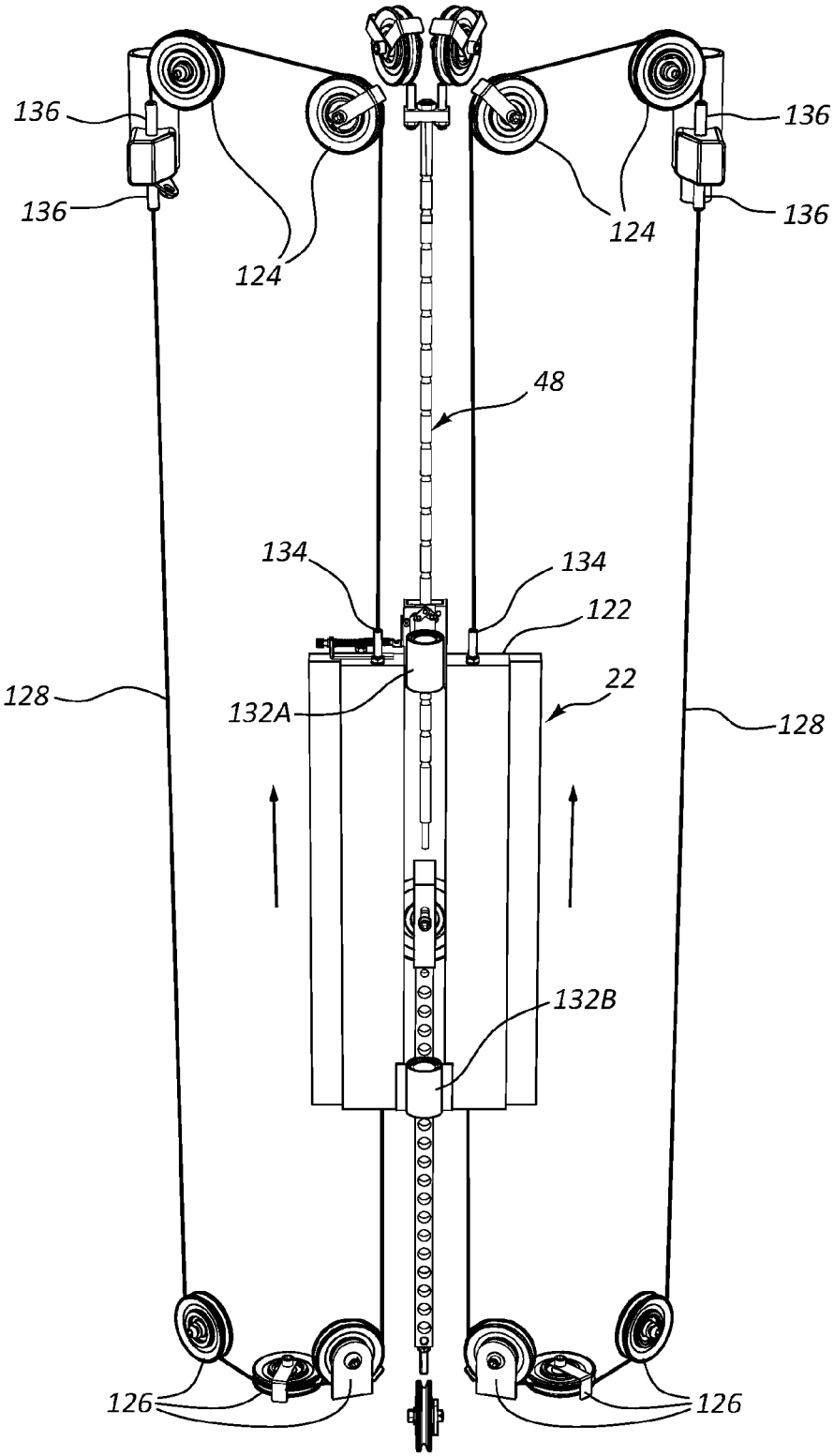
FIG. 17B illustrates the counterweight assembly of FIG. 17A in a raised position.

The counterweight assembly 22 includes counterweights 122, top counterweight pulleys 124, bottom counterweight pulleys 126, counterweight cables 128, a counterweight support rod 130, support rod followers 132A, B, and top and bottom cable connectors 134, 136, as shown in FIGS. 17A and 17B. The counterweight cables 128 connect to the counterweights 122 at the top cable connectors 134. The counterweight cables 128 extend over the top counterweight pulleys 124, wrap around the bottom counterweight pulleys 126, and connect to the bottom cable connectors 136 along the bottom of the counterweights 122. The support rod followers 132A, B follow along the counterweight support rod 130 (e.g., see FIG. 9).

Typically, the counterweights 122 substantially offset the weight of the first and second lift arm assemblies 16, 18. A user may move the first and second lift arm assemblies 16, 18 up and down prior to connecting the plurality of weight members 14 to the carrier rod 48 with relative easy because of the counterbalancing effect of counterweights 122. Connecting the plurality of weight members 14 to the carrier rod 48 provides a coupling between the counterweight assembly 22 and the plurality of weight members 14. The weight of the weight members 42 is coupled to the first and second lift arm assemblies 16, 18 via the counterweight assembly 22 when the first and second connectors 106, 108 are engaged within one of the recesses 68.

The actuator assembly 20 operates differently when no load from the plurality of weight members 14 is applied to the carrier rod 48 as compared to when a load has been applied to the carrier rod 48 (e.g., when the first and second connectors 106, 108 are positioned in one of the recesses 68). FIGS. 9-12 show operation of the actuator assembly 20 prior to applying a weight force from the plurality of weight members 14 to the carrier rod 48. FIGS. 13-16 show operation of the actuator assembly 20 after a force from the plurality of weight members 14 is applied to the carrier rod 48.

Figure 9:
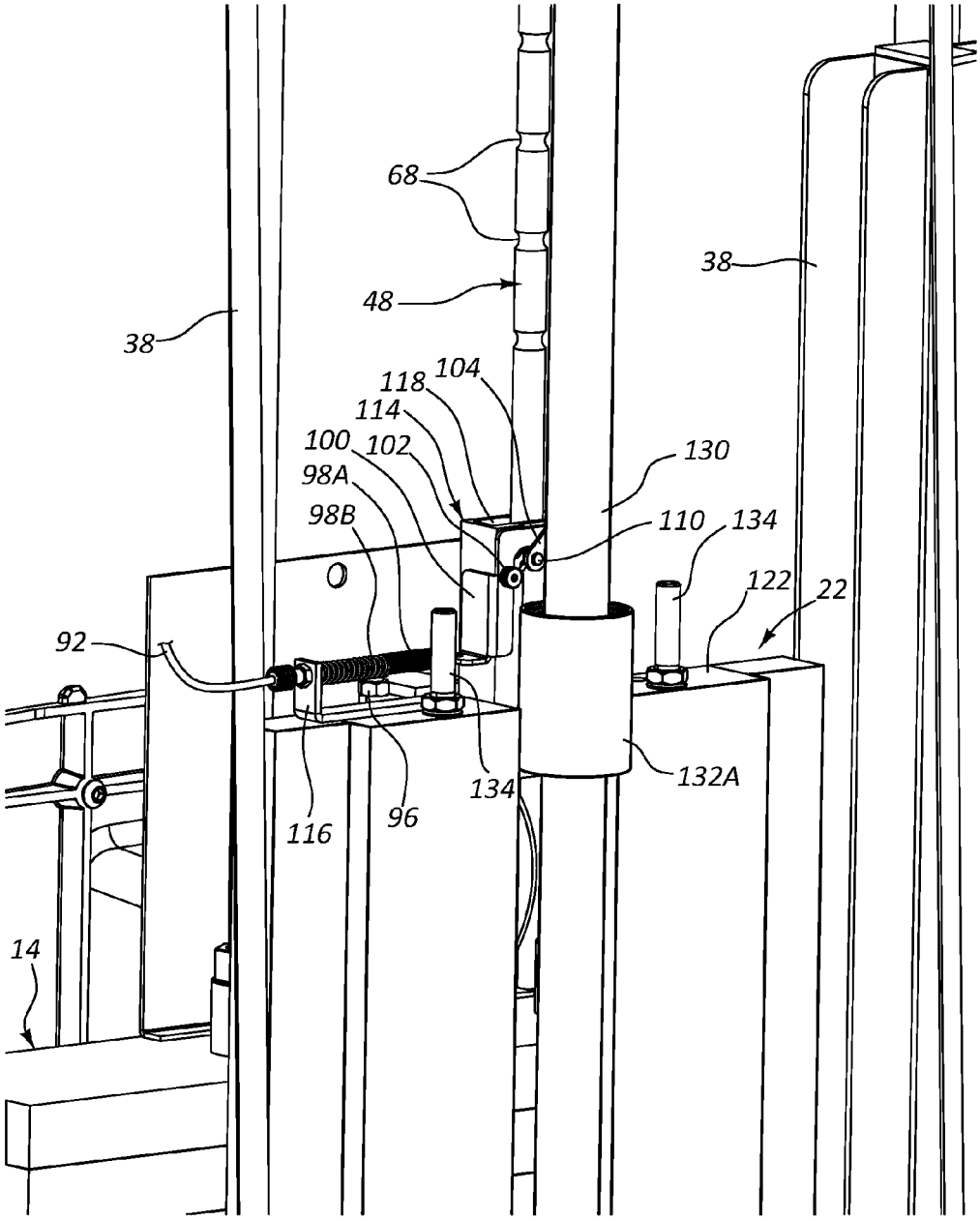
FIG. 9 illustrates a close-up rear perspective view of a portion of an actuator assembly of the exercise apparatus of FIG. 1A prior to actuation and prior to application of a load.

FIGS. 9 and 10 show the actuator assembly 20 prior to being activated by applying tension in the cable 92 using the trigger 90, and prior to applying the weight force of plurality of weight members 14 to the carrier rod 48 (i.e., the first and second connectors 106, 108 are not positioned within one of the recesses 68). The first and second cable springs 98A, B are in a rest state prior to actuation (see FIGS. 9 and 10). The first cable spring 98A is an extension spring having coils positioned directly adjacent to and in contact with each other when the spring is in a rest state. The coils are separable by application of a tension force at an end of the first cable spring 98A, wherein the tension force exceeds a threshold force. The second cable spring 98B is a compression spring wherein the coils are spaced apart relative to each other when the spring is in a rest state. Applying a compression force at an end of the second cable spring 98B moves the coils closer to each other. Releasing the compression force permits the second cable spring 98B to automatically return to the rest state shown in FIGS. 9 and 10.

The first and second connectors 106, 108 are biased into contact with a portion of the carrier rod 48 (e.g., the bottom cable connector 66) with the connector springs 112, as shown in FIG. 10. A weight force from the plurality of weight members 14 is not yet applied to the carrier rod 48 in the arrangement of FIGS. 9 and 10. As such, the first and second connectors 106, 108 are movable into and out of contact with the carrier rod 48 upon application of a tension force in cable 92. Further, when the first and second connectors 106, 108 are positioned outside of the recesses 68 but in contact with other portions of the carrier rod 48, some relative axial movement between the carrier rod and the first and second connectors 106, 108 is possible. In other arrangements, any contact between first and second connectors 106, 108 and carrier rod 48 provides a connection there between that limits axial movement of the carrier rod 48 relative to the first and second connectors 106, 108.

Figure 11:
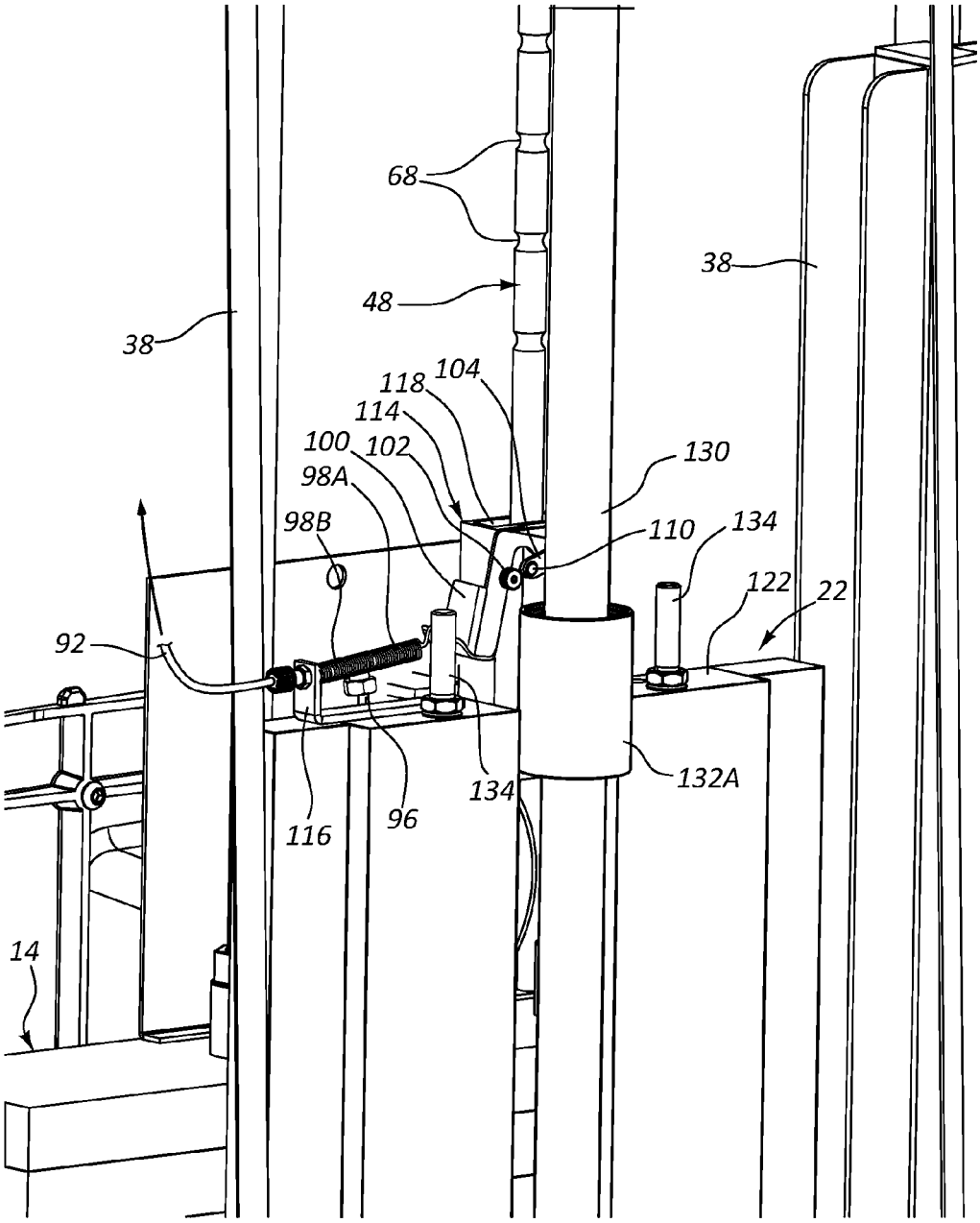
FIG. 11 illustrates a rear perspective view of the portion of the actuator assembly of FIG. 9 in an actuated position and prior to application of a load.

Referring now to FIGS. 11 and 12, the actuator assembly 20 is operated to move the first and second connectors 106, 108 out of contact with the carrier rod 48. The actuator assembly 20 is operated by actuating the trigger 90 at the first lift arm assembly 16, which creates tension in cable 92. The tension in cable 92 moves the cable connector 96 axially to compress the second cable spring 98B and move the first cable spring 98A axially away from housing 114, which rotates the lever 100 about the lever pivot member 102. The first cable spring 98A has a stiffness (e.g., a resistance to extension) sufficient to transfer the axial force applied by the tension in cable 92 to a rotational force applied to lever 100. Rotating lever 100 rotates the linkage 104, thereby rotating the first and second connectors 106, 108 out of contact with the carrier rod 48, as shown in FIG. 12. The first and second connectors 106, 108 move the followers 107 along the track 121 when being rotating out of contact with the carrier rod 48. The housing 114 and mounting bracket 116 are mounted directly to counterweights 122 of the counterweight assembly 22. As such, operating the actuator assembly 20 when no weight force from the plurality of weight members 14 is applied to the carrier rod 48 permits relative axial movement between the counterweight assembly 22 and the carrier rod 48 in the direction X, as shown in FIG. 12.

Releasing actuation of the trigger 90 releases tension in the cable 92. The second cable spring 98B applies an axial force that returns the lever 100 to its rest position shown in FIGS. 9 and 10. The connector springs 112 bias the first and second connectors 106, 108 back into their rest position in contact the carrier rod 48, as shown in FIG. 10. Typically, the user moves the first and second lift arm assemblies 16, 18 vertically downward while the trigger 90 is actuated, thereby moving the first and second connectors 106, 108, and the counterweight 122 to which the first and second connectors 106, 108 are connected, along the length of the carrier rod 48 and into engagement with one of the recesses 68. Releasing the trigger 90 permits the first and second connectors 106, 108 to rest within one of the recesses 68. The weight force from the plurality of weight members 14 is then applied to the user, who lifts vertically as part of the squat exercise.

Once the first and second connectors 106, 108 are engaged within one of the recesses 68, the load of plurality of weight members 14 is connected to the carrier rod 48 as soon as the user begins moving the first and second lift arm assemblies 16, 18 vertically upward. The user lifts the weight members 42 of the plurality of weight members 14 by moving the first and second lift arm assemblies 16, 18 vertically upward.

Figure 13:
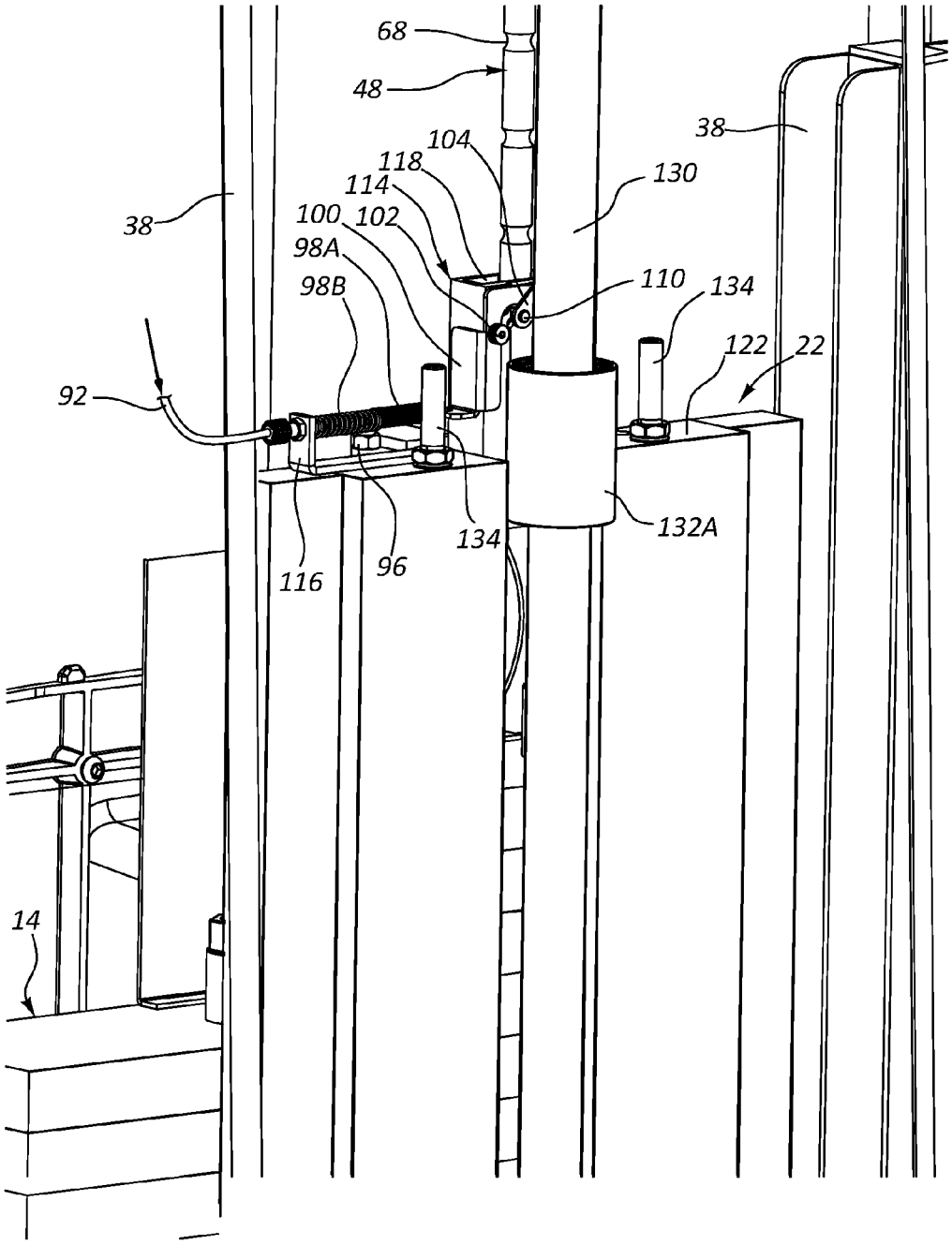
FIG. 13 illustrates a rear perspective view of the portion of the actuator assembly of FIG. 9 prior to actuation and with a load applied.
Figure 15:
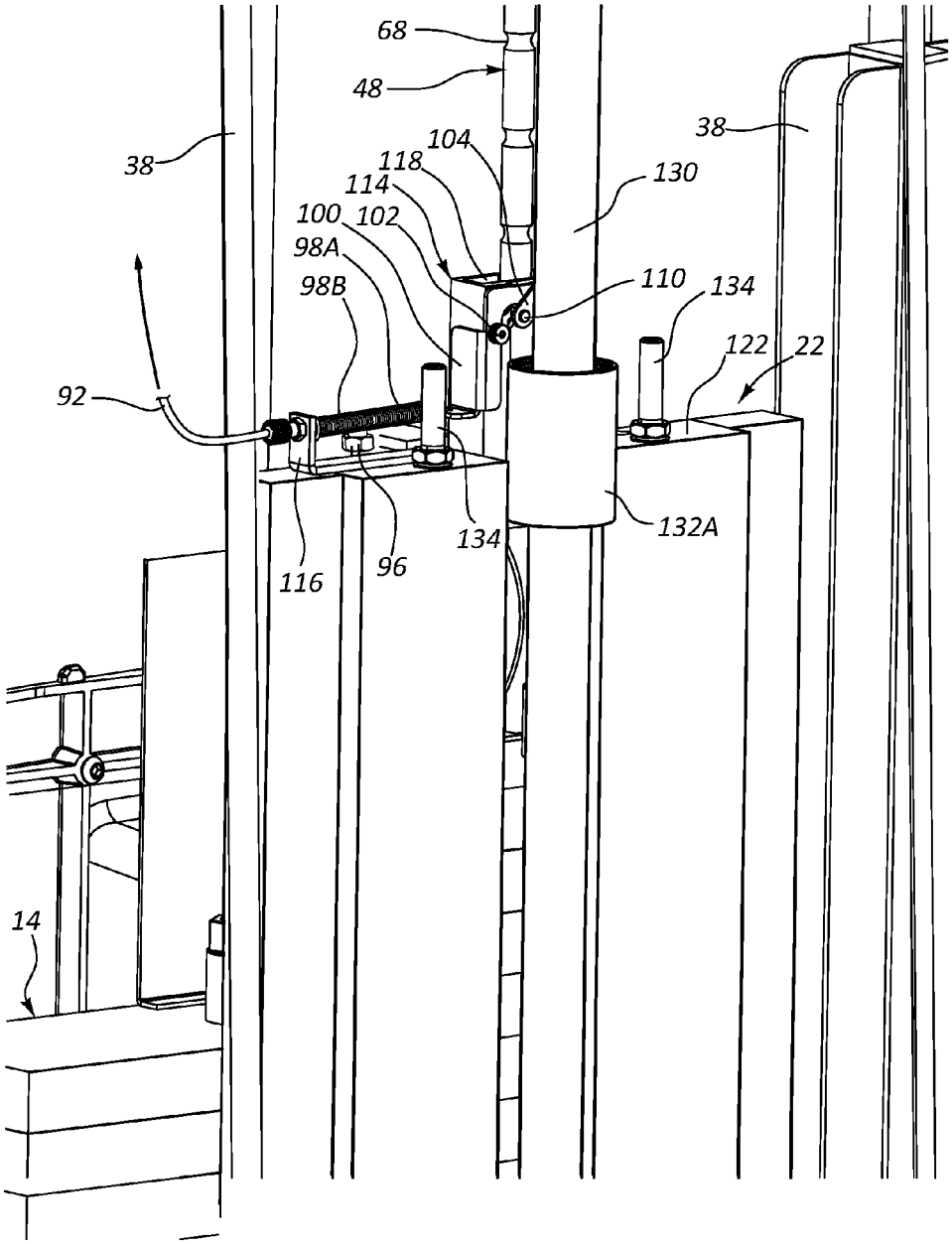
FIG. 15 illustrates a rear perspective view of the portion of the actuator assembly of FIG. 13 in an actuated position and with a load applied.
Figure 16:
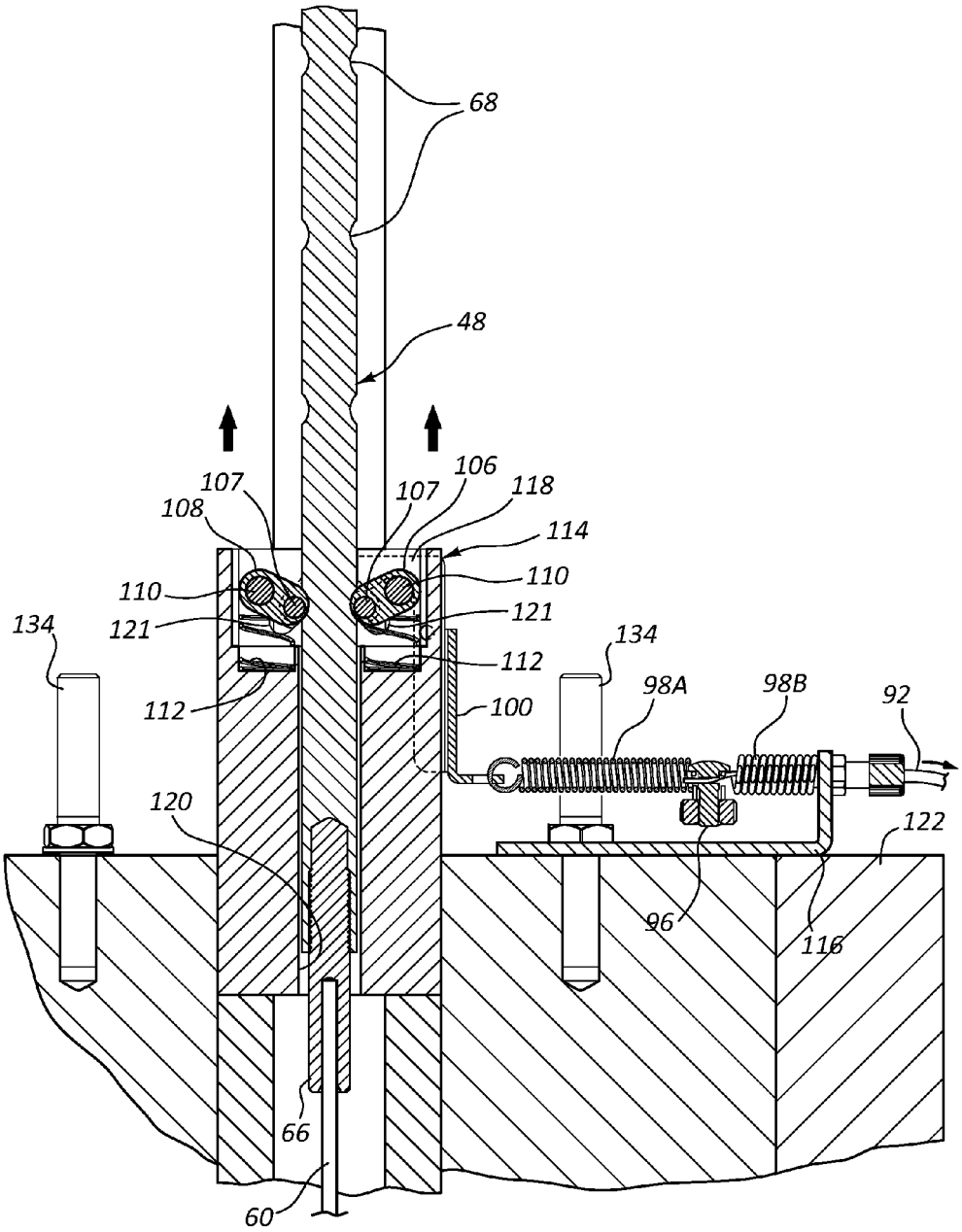
FIG. 16 illustrates a front view of the portion of the actuator assembly of FIG. 15.

The actuator assembly 20 may adjust an engagement position of at least one of the weight members 42 relative to and during movement of at least one lift arm 70 of either the first and/or second lift arm assemblies 16, 18. The operation of the actuator assembly 20 may differ when the weight force of the plurality of weight members 14 is applied to the carrier rod 48 as the user raises the first and second lift arm assemblies 16, 18, compared to when there is a lack of applied weight force (e.g., as described above with reference to FIGS. 9-12). FIGS. 13 and 14 show the first and second connectors 106, 108 positioned within the recesses 68 and the weight force applied to carrier rod 48. FIGS. 15 and 16 show the actuator assembly 20 in an actuated position in which the trigger 90 is operated to create tension in cable 92. The weight force applied by the plurality of weight members 14 to the carrier rod 48 creates resistance to rotation of the first and second connectors 106, 108 into the released position shown in FIG. 12. This resistance to rotation tends to make it more difficult to rotate lever 100 and associated linkage 104. As such, applying tension in cable 92 extends the first cable spring 98A and compresses the second cable spring 98B rather than applying a rotation force to the lever 100 (see FIGS. 15 and 16). The first and second connectors 106, 108 remain engaged with the carrier rod 48 such that the weight force of plurality of weight members 14 remains applied to the user. Releasing the trigger 90 to release tension in cable 92 permits the first and second cable springs 98A, 98B to return to their rest positions (e.g., the position of FIGS. 13 and 14) without rotating lever 100.

The operation of actuator assembly 20 in the arrangement of FIGS. 13-16, wherein a weight force is applied by the plurality of weight members 14 to the carrier rod 48, the actuator assembly 20 provides a safety function in which the plurality of weight members 14 cannot be released until the plurality of weight members 14 is in a rest or lowered position to relieve the applied weight force. Once the plurality of weight members 14 returns to the rest or lowered position, operating the actuator assembly 20 provides disconnection of the first and second connectors 106, 108 from within the recesses 68 of the carrier rod 48, thereby permitting raising and lowering of the counterweight assembly 22 without being coupled to the plurality of weight members 14. If the plurality of weight members 14 is disconnected from the carrier rod 48 while the weight members 42 were raised, the weight force would immediately release and the weight members 42 would rapidly drop within the tower, thereby potentially causing damage to the squat exercise apparatus 10 or injury to the user.

Other embodiments may be possible in which the plurality of weight members 14 are disconnectable from the carrier rod 48 after the weight force is applied to the carrier rod 48, and other features, such as biasing members, shock absorbers, or cushioning members, are provided to slow down the drop of the weight members 42 or dampen impact forces when the weight members 42 are disconnected.

Others actuating systems, methods and devices may be used in other embodiments to provide selective coupling of the plurality of weight members to the lift arms of a squat exercise apparatus. For example, motors, sensors, switches and other electronic devices may be used in place of the linkages, triggers, cables and other mechanical features of the actuator assemblies described herein. Other types of actuators besides the rotatable pawls shown in the figures (e.g., first and second connectors 106, 108) may have advantages in other designs. In at least some examples, wireless communications may be employed to communicate instructions from the user, who is positioned away from the tower and engaged with the lift arm assemblies, to the actuation device which is positioned inside the tower and used to couple the plurality of weight members to the lift arm assemblies.

As mentioned above, the actuator assembly 20 may provide user selection of the lowest position of the lift arm assemblies 16, 18 during the squat exercise. The user may position himself below the lift arm assemblies 16, 18 with the user's shoulders in contact with the shoulder pads 80. The user may then actuate the trigger 90, which ensures disconnection of the weight force of the plurality of weights 14 from being applied to the lift arm assemblies 16, 18. The user may grasp the first and/or second hand grips 82, 84 and move up and down through a squat exercise. The user typically has relatively little resistance applied by the lift arm assemblies 16, 18 while the trigger 90 is actuated due to the counterbalancing forces of the counterweight assembly 22 applied to the lift arm assemblies 16, 18. At some lowered position from the highest or top position for the lift arm assemblies 16, 18 shown in FIGS. 1A-7, the user releases the trigger 90. Once the trigger 90 is released, the first and second connectors 106, 108 rotate into contact with the carrier rod 48. Further raising or lowering the lift arm assemblies 16, 18 moves the first and second connectors 106, 108 along the length of the carrier rod 48 until engaging within one of the recesses 68. Thereafter, the lowest position of the lift arm assemblies 16, 18 is defined by the vertical position of the engaged recess 68 until the first and second connectors 106, 108 are moved out of that recess 68 and moved into a different vertical position relative to the carrier rod 48. The user may then raise the first and second lift arm assemblies 16, 18 against the weight force of the plurality of weight members 14 to perform a squat exercise.

Figure 20:
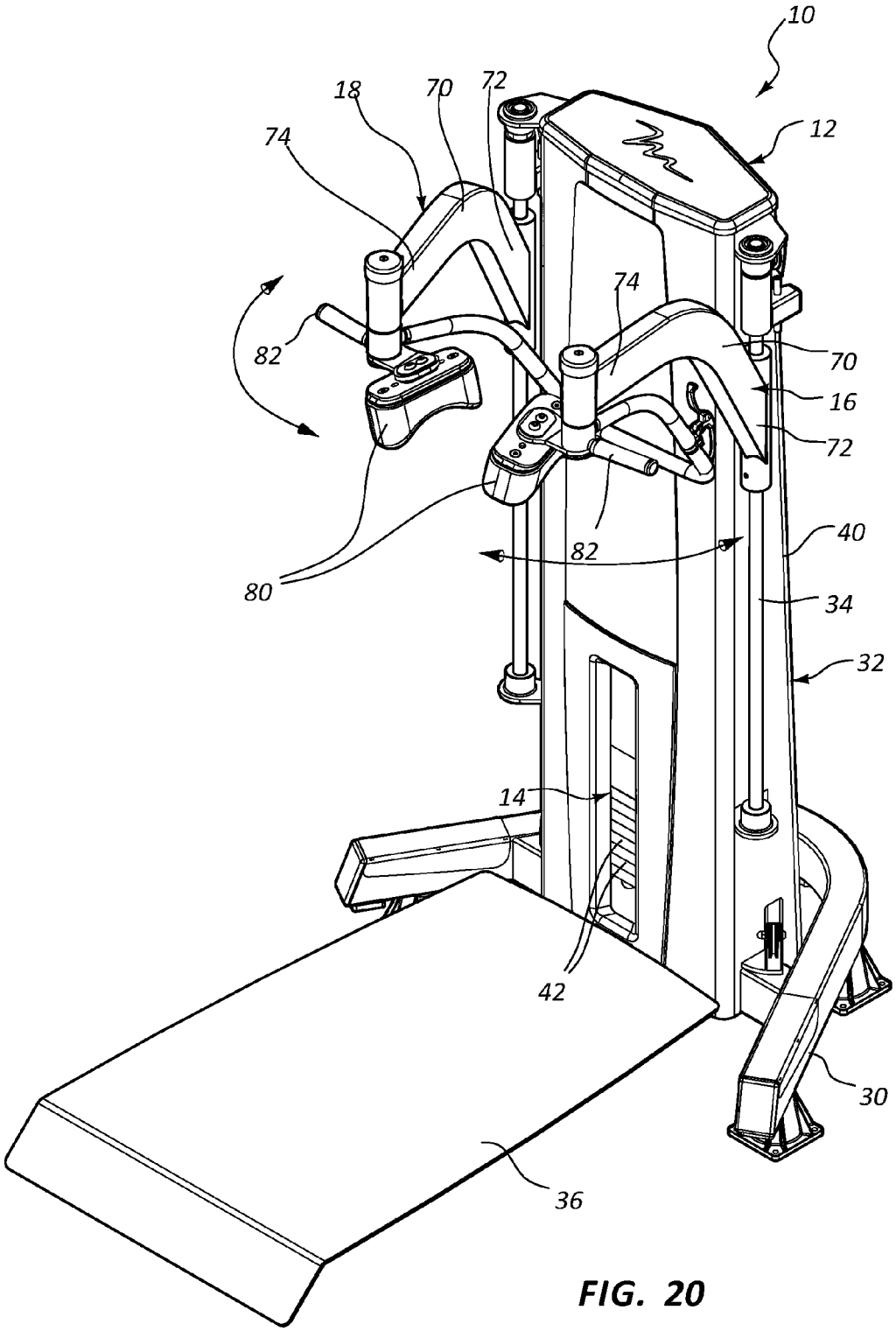
FIG. 20 illustrates a perspective view of a portion of the exercise apparatus of FIG. 1A showing the arms moved laterally.

Referring now to FIG. 20, the user of the squat exercise apparatus can move the arms 74 about the arm supports 34. Thus, the arms 74 have multiple degrees of freedom. They can move vertically along the length of the arm supports 34 and move laterally by pivoting about the arm supports 34. The arm's rotational degree of freedom causes the user to engage his or her stabilizer muscles. Further, the arm's rotational degree of freedom allows the user to perform exercises that incorporate lateral movement. For example, the user may desire to lean to the side or jump to the side as he or she performs a lift. The squat exercise apparatus as described above can accommodate such lateral movements by the user during such lifts.

As the arms 74 move laterally, the shoulder pads 80 pivot to remain on the user's shoulders. Thus, in some examples, the user may maintain a comfortable engagement with the arms 74 regardless of whether the user is twisting, moving laterally, or moving straight up during the lift. In some examples, the arms 74 are connected to one another such that the arms 74 move together when a force causes one of the arms to move laterally. In some of such examples, the arms 74 may remain in a parallel arrangement or in a substantially parallel arrangement as the arms move laterally.

While the examples above have been described with reference to specific features and arrangements of such features, the exercise apparatus may incorporate more or less features and be arranged in different ways than described in the above examples. In some examples, the amount of vertical travel available to lift the arms is maximized when the user stands erect with the arms lifted and resting on his or her shoulders. In such an example, the arms may top out as the user completes his or lift. In other examples, there is sufficient travel to allow the user to stand erect while also standing on his or her tip toes at the end of the lift. In yet other examples, there is sufficient travel to allow the user to hop or jump at the end of his or her lift.

INDUSTRIAL APPLICABILITY

The squat exercise apparatuses disclosed herein provide improved control over application of a weight force to the lift arm assemblies during a squat exercise. The squat exercise apparatus includes an actuator assembly that may adjust an engagement position of at least one weight member of the plurality of weight members relative to and during movement of the at least one lift arm. The actuator assembly may be positioned to couple and decouple a weight force from the plurality of weight members to the first and second lift arm assemblies of the squat exercise apparatus. The actuator assembly may include an actuator such as a trigger that is positioned in close proximity to the user while the user is operating the squat exercise apparatus through a squat exercise motion. The actuator may be mounted to a portion of one of the lift arm assemblies such as, for example, a hand grip extending from one of the lift arms. The trigger may be coupled to a cable that extends through or along portions of the first and second lift arm assemblies and into the tower of a support structure of the squat exercise apparatus. Another portion of the actuator assembly may be operable within the tower to selectively couple or decouple the plurality of weight members to the lift are assemblies.

Portions of the actuator assembly may be mounted to one or more counterweights of a counterweight assembly of the squat exercise apparatus. The counterweights may be movable relative to a carrier rod, which is coupled to the weight members of the plurality of weights. Operating the actuator assembly may connect or disconnect the at least one connector relative to the carrier rod. Once the connector is connected to the carrier rod, the weight force applied by the weight members of the plurality of weight members are operably coupled to the counterweights and provide resistance for the user during a squat exercise.

The actuator assembly may provide a feature that limits inadvertent disconnection of the weight members once the weight members are connected to the carrier rod and the operator is lifting the weight members during a squat exercise. Typically, the at least one connector of the actuator assembly is disconnectable from the carrier rod only after the weight members have reached a lowered or rest state to remove the weight force from the carrier rod.

A method of exercising using the example squat exercise apparatus as disclosed herein may include providing the support structure, a plurality of weights, at least one lift arm, and an actuator assembly. The method further includes supporting the at least one lift arm on a user's shoulders, and actuating the actuator assembly at a location remote from the plurality of weight members (e.g., a location along or supported by the at least one lift arm) to selectively couple at least some of the plurality of weight members to the at least one lift arm. The method may further include moving the at least one lift arm to lift the plurality of weight members as the user moves through a squat motion. The method may also include a trigger and a release assembly coupled to the trigger, and operating the trigger disconnects the release assembly from the plurality of weights. The release assembly may be coupled to a counterweight assembly.

What is claimed is:

1. An exercise apparatus, comprising:

a plurality of weight members;

at least one lift arm having a first end coupled to the plurality of weight members and a second end arranged for contact by a user to move the at least one lift arm;

an actuator assembly that selectively couples the at least one lift arm to at least one weight member of the plurality of weight members, a portion of the actuator assembly being carried by the at least one lift arm;

wherein the actuator assembly adjusts an engagement position of the at least one weight member relative to and during movement of the at least one lift arm;

wherein the actuator assembly includes a first connection member and a second connection member operable between a first position disconnected from a carrier rod to permit movement of the at least one lift arm without lifting the plurality of weight members, and a second position connected to the carrier rod to permit lifting of the plurality of weight members; and wherein the carrier rod includes a plurality of recesses defined by the carrier rod at spaced apart locations along a length of the carrier rod, the first connection member and the second connection member being positioned in one of the plurality of recesses when in the first position.

2. The exercise apparatus of claim 1, further comprising at least one hand grip coupled to the second end of the at least one lift arm.

3. The exercise apparatus of claim 2, wherein the actuator assembly comprises a trigger mounted to the at least one hand grip.

4. The exercise apparatus of claim 1, wherein the exercise apparatus further comprises:

a weight selector operable to select a number of weight members from the plurality of weight members for lifting by the at least one lift arm.

5. The exercise apparatus of claim 4, wherein the carrier rod extends through the plurality of weight members, the weight selector being selectively connected to the carrier rod to adjust a number of weight members from the plurality of weight members for lifting by the at least one lift arm.

6. The exercise apparatus of claim 1, wherein the actuator assembly comprises a release assembly movable by applying tension to couple the at least one lift arm to or decouple the at least one lift arm from the plurality of weight members.

7. The exercise apparatus of claim 1, wherein the actuator assembly is biased into a position in which the at least one lift arm is coupled to the plurality of weight members.

8. The exercise apparatus of claim 1, wherein the actuator assembly further comprises a biasing member configured to bias the first and second connection members into the first position when at least one weight member of the plurality of weight members is in a lifted position and the actuator assembly is operated to decouple the at least one lift arm from the at least one weight member.

9. The exercise apparatus of claim 1, further comprising a counterweight coupled to the at least one lift arm, wherein the first and second connection members are carried by the counterweight.

10. An exercise apparatus comprising:

a plurality of weight members;

at least one lift arm; and an actuator assembly, wherein the actuator assembly includes:

a trigger mounted to the at least one lift arm;

a release assembly operable upon actuation of the trigger to selectively couple at least some of the plurality of weight members to the at least one lift arm, the actuator assembly adjusts an engagement position of the at least one weight member relative to and during movement of the at least one lift arm;

wherein the actuator assembly includes a first connection member and a second connection member operable between a first position disconnected from a carrier rod to permit movement of the at least one lift arm without lifting the plurality of weight members, and a second position connected to the carrier rod to permit lifting of the plurality of weight members; and wherein the carrier rod includes a plurality of recesses defined by the carrier rod at spaced apart locations along a length of the carrier rod, the first connection member and the second connection member being positioned in one of the plurality of recesses when in the first position.

11. The exercise apparatus of claim 10, wherein the actuator assembly further comprises a cable extending from the trigger to the release assembly.

12. The exercise apparatus of claim 11, wherein the cable extends through a portion of the at least one lift arm.

13. The exercise apparatus of claim 10, wherein the at least one lift arm includes a hand grip and the trigger is mounted to the hand grip.

14. The exercise apparatus of claim 10, further comprising a counterweight, the release assembly being mounted to the counterweight.

15. The exercise apparatus of claim 10, further comprising a carrier rod coupled to the plurality of weight members, the release assembly being operable between a first position connected to the carrier rod and a second position disconnected from the carrier rod.

16. The exercise apparatus of claim 10, wherein the at least one lift arm is arranged to rotate laterally.

17. A method of exercising, comprising:

providing a plurality of weight members, at least one lift arm having a first end coupled to the plurality of weight members and a second end arranged for contact by a user to move the at least one lift arm, and an actuator assembly;

supporting the at least one lift arm on a user's shoulders;

actuating the actuator assembly at a location remote from the plurality of weight members to selectively couple at least some of the plurality of weight members to the at least one lift arm, a portion of the actuator assembly being carried by the at least one lift arm; and moving the at least one lift arm to lift the plurality of weight members;

wherein the actuator assembly adjusts an engagement position of the at least one weight member relative to and during movement of the at least one lift arm;

wherein the actuator assembly includes a first connection member and a second connection member operable between a first position disconnected from a carrier rod to permit movement of the at least one lift arm without lifting the plurality of weight members, and a second position connected to the carrier rod to permit lifting of the plurality of weight members; and wherein the carrier rod includes a plurality of recesses defined by the carrier rod at spaced apart locations along a length of the carrier rod, the first connection member and the second connection member being positioned in one of the plurality of recesses when in the first position.

18. The method of exercising of claim 17, wherein the at least one lift arm includes a hand grip, the actuator assembly includes a trigger mounted to the hand grip, and actuating the actuator assembly includes operating the trigger.

* * * * *